US011828188B2

(12) United States Patent
Japikse

(10) Patent No.: US 11,828,188 B2
(45) Date of Patent: Nov. 28, 2023

(54) FLOW CONTROL STRUCTURES FOR ENHANCED PERFORMANCE AND TURBOMACHINES INCORPORATING THE SAME

(71) Applicant: Concepts NREC, LLC, White River Junction, VT (US)

(72) Inventor: David Japikse, Woolwich, ME (US)

(73) Assignee: Concepts NREC, LLC, White River Junction, VT (US)

( * ) Notice: Subject to any disclaimer, the term of this patent is extended or adjusted under 35 U.S.C. 154(b) by 0 days.

(21) Appl. No.: 18/020,005

(22) PCT Filed: Aug. 5, 2021

(86) PCT No.: PCT/US2021/071119
§ 371 (c)(1),
(2) Date: Feb. 6, 2023

(87) PCT Pub. No.: WO2022/032296
PCT Pub. Date: Feb. 10, 2022

(65) Prior Publication Data

US 2023/0279785 A1 Sep. 7, 2023

Related U.S. Application Data

(60) Provisional application No. 62/706,286, filed on Aug. 7, 2020.

(51) Int. Cl.
*F01D 5/04* (2006.01)
*F04D 29/28* (2006.01)
*F01D 25/24* (2006.01)

(52) U.S. Cl.
CPC ..... *F01D 25/24* (2013.01)

(58) Field of Classification Search
CPC . F01D 5/04; F04D 29/28; F04D 29/18; F04D 29/22; F04D 29/26; F04D 29/441; F05D 2250/294
See application file for complete search history.

(56) References Cited

U.S. PATENT DOCUMENTS 2,029,813 A 10/1933 De Mey
2,967,013 A 10/1954 Dallenbach et al.
(Continued)

FOREIGN PATENT DOCUMENTS

CN 101263305 B 3/2013
EP 1134427 A1 9/2001
(Continued)

OTHER PUBLICATIONS

Elder, R.L.; "Enhancement of Turbocompressor Stability"; Proceedings of School of the Institution of Mechanical Engineers: Developments in Industrial Compressors and Their Systems; IMechE Mechanical Engineering Publications Limited, IMechE 1994-2; pp. 145-158.
(Continued)

*Primary Examiner* — Igor Kershteyn
(74) *Attorney, Agent, or Firm* — Downs Rachlin Martin PLLC

(57) ABSTRACT

Flow control devices and structures for turbomachines. In some examples, the flow control devices and structures include various arrangements of flow guiding channels, partial height vanes, and other treatments located on one or both of a shroud and hub side of a turbomachine to redirect, guide, or otherwise influence portions of a turbomachine flow field to thereby improve the performance of the machine.

25 Claims, 16 Drawing Sheets

(56) References Cited

U.S. PATENT DOCUMENTS

| | | | | |
|---|---|---|---|---|
| 2,991,927 | A | 7/1961 | Quick | |
| 3,369,737 | A | 2/1968 | Switzer et al. | |
| 3,506,373 | A | 4/1970 | Danker et al. | |
| 3,625,630 | A | 12/1971 | Soo | |
| 3,652,176 | A * | 3/1972 | Walsh | F01D 21/045 415/182.1 |
| 3,663,117 | A * | 5/1972 | Warren | C02F 3/205 261/93 |
| 3,781,128 | A | 12/1973 | Bandukwalla | |
| 3,893,787 | A | 7/1975 | Jones | |
| 3,904,312 | A | 9/1975 | Exley | |
| 4,006,997 | A | 2/1977 | Friberg | |
| 4,063,848 | A | 12/1977 | Wiggins et al. | |
| 4,086,022 | A | 4/1978 | Freeman et al. | |
| 4,131,389 | A | 12/1978 | Perrone et al. | |
| 4,212,585 | A | 7/1980 | Swarden et al. | |
| 4,218,182 | A | 8/1980 | Harada et al. | |
| 4,421,457 | A | 12/1983 | Yoshinaga et al. | |
| 4,445,816 | A | 5/1984 | Ribaud et al. | |
| 4,479,755 | A | 10/1984 | Skoe | |
| 4,606,699 | A | 8/1986 | Hemsworth | |
| 4,743,161 | A | 5/1988 | Fisher et al. | |
| 4,781,530 | A | 11/1988 | Lauterbach et al. | |
| 4,824,325 | A | 4/1989 | Bandukwalla | |
| 4,877,373 | A | 10/1989 | Bandukwalla | |
| 4,902,200 | A | 2/1990 | Bandukwalla | |
| 5,137,419 | A | 8/1992 | Waterman | |
| 5,178,516 | A | 1/1993 | Nakagawa et al. | |
| 5,228,832 | A | 7/1993 | Nishida et al. | |
| 5,310,309 | A | 5/1994 | Terasaki et al. | |
| 5,316,441 | A | 5/1994 | Osborne | |
| 5,368,440 | A | 11/1994 | Japikse et al. | |
| 5,489,186 | A | 2/1996 | Yapp et al. | |
| 5,730,580 | A | 3/1998 | Japikse | |
| 5,857,834 | A * | 1/1999 | Nagaoka | F04D 1/06 415/199.1 |
| 6,164,911 | A | 12/2000 | LeBlanc et al. | |
| 6,273,677 | B1 | 8/2001 | Wang et al. | |
| 6,290,458 | B1 | 9/2001 | Irie et al. | |
| 6,508,626 | B1 | 1/2003 | Sakurai et al. | |
| 6,619,909 | B2 | 9/2003 | Barnett et al. | |
| 6,699,008 | B2 | 3/2004 | Japikse | |
| 6,877,953 | B2 | 4/2005 | Guemmer | |
| 7,025,557 | B2 | 4/2006 | Japikse et al. | |
| 7,186,072 | B2 | 3/2007 | Seitz | |
| 7,189,059 | B2 | 3/2007 | Barton et al. | |
| 7,338,251 | B2 | 3/2008 | Ro | |
| 7,658,592 | B1 | 2/2010 | Jarrah et al. | |
| 7,758,303 | B1 | 7/2010 | Wadia | |
| 7,909,580 | B2 | 3/2011 | Simpson et al. | |
| 7,941,300 | B1 | 5/2011 | Bowers | |
| 8,016,557 | B2 | 9/2011 | Abdelwahab et al. | |
| 8,043,046 | B2 | 10/2011 | Guemmer | |
| 8,162,604 | B2 | 4/2012 | Kuhnel et al. | |
| 8,251,648 | B2 | 8/2012 | Johann | |
| 8,506,237 | B2 | 8/2013 | Japikse et al. | |
| 9,845,810 | B2 | 12/2017 | Japikse | |
| 9,970,456 | B2 | 5/2018 | Japikse | |
| 11,085,460 | B2 | 8/2021 | Japikse | |
| 2003/0152456 | A1 | 8/2003 | Guemmer | |
| 2007/0036647 | A1 | 2/2007 | Abdelwahab et al. | |
| 2008/0044273 | A1 | 2/2008 | Khalid | |
| 2008/0095614 | A1 | 4/2008 | Aubin | |
| 2009/0041576 | A1 | 2/2009 | Guemmer et al. | |
| 2009/0263233 | A1 | 10/2009 | Guemmer | |
| 2009/0311095 | A1 | 12/2009 | Blewett et al. | |
| 2011/0097203 | A1 | 4/2011 | Shibata et al. | |
| 2012/0014788 | A1 | 1/2012 | Blair et al. | |
| 2013/0195608 | A1 | 8/2013 | Gharaibah et al. | |
| 2014/0205458 | A1 | 7/2014 | Japikse | |
| 2014/0294564 | A1* | 10/2014 | Matwey | F04D 29/444 415/58.3 |
| 2014/0341706 | A1 | 11/2014 | Lardy | |
| 2015/0369073 | A1 | 12/2015 | Japikse | |
| 2016/0342730 | A1 | 11/2016 | Choi et al. | |

FOREIGN PATENT DOCUMENTS

| | | | |
|---|---|---|---|
| GB | 2034435 | A | 10/1925 |
| JP | H05149296 | A | 6/1993 |
| JP | 2002257093 | A | 9/2002 |
| JP | 2006170112 | A | 6/2006 |
| JP | 2009068431 | A | 4/2009 |
| JP | 2009299681 | A | 12/2009 |
| JP | 2010025000 | A | 2/2010 |
| WO | 1992015787 | A1 | 9/1992 |
| WO | 2014184368 | A1 | 11/2014 |

OTHER PUBLICATIONS

Rogers; "The Performance of Centrifugal Compressor Channel Diffusers"; 1982; ASME Paper No. 82-GT-10.

Kenny; "Supersonic Radial Diffusers"; 1970; Advanced compressors, AGARD Lecture Series No. 39.

Pampreen; "Automotive Research Compressor Experience"; 1990; A. ASME Paper No. 89-GT-61; Trans ASME Journal Turbomachiner 112(1): 1-6.

Chapman; "Model 250-C30/C28B Compressor Development"; 1980; Centrifugal Compressors, Flow Phenomena and Performance, AGARD Conference Proceedings No. CP-282.

Fisher; "Application of Map Width Enhancement Devices to Turbocharger Compressor Stages"; 1989; SAE Paper No. 880794, Power Boost: Light, Medium and Heavy Duty Engines, SP-780.

Jansen et al.; "Improvements in Surge Margin for Centrifugal Compressors"; 1980; Centrifugal Compressors, Flow Phenomena and Performance, AGARD Conference Proceedings No. CP-282.

Japikse et al.; "Centrifugal Compressor Design and Performance"; 1996; Concepts ETI, Inc.; Chapters 2, 3, 5, and 7.

Japikse; "The influence of diffuser inlet pressure fields on the range and durability of centrifugal compressor stages"; 1980; AGARD CP-282.

Yoshinaga et al.; "Aerodynamic performance of a centrifugal compressor with vaned diffusers"; 1980; Trans ASME Journal Fluids Eng 102:486-493.

Kenny; "A Novel Low-Cost Diffuser for High-Performance Centrifugal Compressors"; 1969; Journal Engineering for Power; pp. 37-47.

Amann et al.; "The Role of the Compressor in Limiting Automotive Gas Turbine Acceleration"; 1961; Centrifugal Compressors; SAE Technical Progress Series, vol. 3.

Amann et al.; "Casing Modification for Increasing the Surge Margin of a Centrifugal Compressor in an Automotive Turbine Engine"; 1975; Trans ASME Journal of Engineering for Power 97(3):329-336.

Elder et al.; "A Discussion of the Factors Affecting Surge in Centrifugal Compressors"; 1984; ASME Paper No. 84-FT-194; Trans ASME Journal Engineering Gas Turbine and Power, 107(2): 499-506.

Prumper; "Application of Boundary Layer Fences in Turbomachinery"; Jan. 31, 1973; AGARD Advisory Group for Aerospace Research & Development; AGARDograph No. 164 on Boundary Layer Effects in Turbomachines; P188231, No. 111.

Hildebrandt et al.; "Numerical Investigation of the Effect of Different Back Sweep Angle and Exducer Width on the Impeller Outlet Flow Pattern of a Centrifugal Compressor with Vaneless Diffuser"; Apr. 2007; Journal of Turbomachinery, vol. 129, ASME.

Bonaiuti et al.; "On the Coupling of Inverse Design and Optimization Techniques for the Multiobjective, Multipoint Design of Turbomachinery Blades"; Apr. 2009; Journal of Turbomachinery, vol. 131, ASME.

Veressm et al.; "Inverse Design and Optimization of a Return Channel for a Multistage Centrifugal Compressor"; Sep. 2004; Journal of Fluids Engineering, vol. 126, ASME.

Japikse et al., "Centrifugal Pump Design and Performance"; 1997; Concepts ETI, Inc.; Chapters 2, 3, 5 and 9.

PCT International Search and Written Opinion dated Nov. 4, 2021, issued in International Application No. PCT/US2021/071119.

* cited by examiner

FLOW CONTROL STRUCTURES FOR ENHANCED PERFORMANCE AND TURBOMACHINES INCORPORATING THE SAME

RELATED APPLICATION DATA

This application claims the benefit of priority of U.S. Provisional Patent Application Ser. No. 62/706,286, filed Aug. 7, 2020, and titled "Enhanced Performance Imbedded Diffuser Passages and Grooved Turbomachinery Impeller Covers", which is incorporated by reference herein in its entirety.

FIELD OF THE DISCLOSURE

The present disclosure generally relates to the field of turbomachinery. In particular, the present disclosure is directed to flow control structures for enhanced performance and turbomachines incorporating the same.

BACKGROUND

Losses in turbomachinery stages vary in strength and character from case to case, but all turbomachinery stages include most of the following mechanisms for single phase, single component, flow: surface friction, secondary flow generation, exit mixing, clearance gap flows, leakage, and shock formation for highly compressible flows. These mechanisms are in turn influenced by many design parameters, such as flow rate, inlet pressure and temperature, exit pressure, incidence, and flow turning plus surface curvature, thickness, and conditions of rotation, amongst others. Losses negatively affect turbomachine performance and are generally understood to be a degradation of the flow state, leading to total pressure decay and an increase in entropy for the flow process. Losses can also lead to flow separation and stall and impeller slip, as well as non-uniform flow fields that frequently negatively impact performance of downstream elements. A need remains for improved devices and methods for reducing losses and mitigating the effects of losses.

SUMMARY OF THE DISCLOSURE

In one implementation, the present disclosure is directed to a turbomachine. The turbomachine includes a hub surface, a shroud surface, and a plurality of recessed channels located in the hub or shroud surface, each of the recessed channels extending in a flow-wise direction and having an angle profile, ?(M), with respect to a meridional reference plane passing through a corresponding channel at a meridional location M along a length of the channel; and wherein the angle of at least a first portion of each of the channels is designed and configured to be equal to or less than a calculated minimum flow angle of a working fluid at a maximum mass flow rate operating point to thereby increase a coupling of the channels to the working fluid at the maximum mass flow rate operating point.

In another implementation, the present disclosure is directed to a turbomachine. The turbomachine includes a hub surface, a shroud surface; and a plurality of recessed channels extending in a flow-wise direction and located in the hub or shroud surface; and wherein the plurality of channels includes a plurality of first channels and a plurality of second channels, wherein an angle of the first channels with respect to meridional location along the channel, $\alpha 1(M)$, is different than an angle of the second channels with respect to meridional location along the channel, $\alpha 1(M)$, wherein the angles, $\alpha 1(M)$, $\alpha 1(M)$, are an angle of a corresponding one of the first or second channels with respect to a meridional reference plane passing through the channel at a meridional location M along a length of the channel.

In yet another implementation, the present disclosure is directed to a turbomachine. The turbomachine includes a hub surface, a shroud surface; and a plurality of recessed channels extending in a flow-wise direction and located in the hub or shroud surface, each of the channels having a first edge at the hub or shroud surface on a convex side of the channel and a second edge at the hub or shroud surface on a concave side of the channel; and wherein at least a portion of at least one of the first and second edges of at least one of the plurality of channels includes a cusp that forms a scoop to capture and redirect flow into the channel.

In yet another implementation, the present disclosure is directed to a turbomachine. The turbomachines includes a hub surface, a shroud surface; a plurality of recessed channels extending in a flow-wise direction and located in the hub or shroud surface; and a plurality of partial height vanes located proximate corresponding ones of the recessed channels, the partial height vanes designed and configured to improve a coupling of the recessed channels with a working fluid flow field.

In yet another implementation, the present disclosure is directed to a method of creating a flow control structure for a turbomachine having an impeller, a shroud, a hub, and a downstream element. The method includes estimating, in a flow field distribution of the turbomachine, a variation in a flow angle of working fluid proximate the hub or shroud as a function of a mass flow rate; identifying an estimated minimum flow angle at a maximum mass flow rate operating point; and defining at least one channel located in a surface of the hub or shroud for redirecting at least a portion of the working fluid, the defining including selecting a channel angle of the at least one channel that is less than or equal to the estimated minimum flow angle to thereby improve the coupling of the at least one channel with the working fluid at the maximum mass flow rate operating point.

In yet another implementation, the present disclosure is directed to a method of defining a flow control structure for a turbomachine having an impeller having an inlet and an exit, a shroud, a hub, and a downstream element, the hub and shroud defining an impeller passageway, the method includes developing, using a computer, a computational fluids model of the turbomachine; calculating, with the computational fluids model, an impeller passageway flow field distribution at a maximum mass flow rate operating point; determining a flow angle variation in the flow field distribution proximate the hub or shroud; and defining at least one channel that extends in a flow-wise direction in at least one of the hub and the shroud, the defining including defining a channel angle of the at least one channel that is less than or equal to the determined flow angle at the maximum mass flow rate operating point.

BRIEF DESCRIPTION OF THE DRAWINGS

For the purpose of illustrating the disclosure, the drawings show aspects of one or more embodiments of the disclosure. However, it should be understood that the present disclosure is not limited to the precise arrangements and instrumentalities shown in the drawings, wherein.

DETAILED DESCRIPTION

Aspects of the present disclosure include flow control devices and structures that are designed and configured to do one or more of: reduce the negative impact of losses on the performance of a turbomachine, improve the performance of a turbomachine, reduce the negative impact of losses on downstream elements that are generated in upstream elements, and improve the coupling and performance of upstream and downstream elements. As described more below, exemplary flow control devices made in accordance with the present disclosure may include various arrangements of flow guiding channels, partial height vanes, and other treatments, that may be located on one or both of a shroud and hub side of a turbomachine to redirect, guide, or otherwise influence portions of a turbomachine flow field to thereby improve the performance of the machine.

Turbomachines, whether radial, axial, or mixed flow, and whether compressors, pumps, or turbines, etc., generally include an impeller that has a plurality of blades and that rotates about an axis of rotation and that is disposed within a fluid passage. The term impeller, as used herein, refers to any type of bladed impeller or rotor of any type of turbomachine, including compressors, turbines, pumps, and fans. Turbomachine impellers have an inlet and an exit and are typically in fluid communication with a downstream element, such as a diffuser or cascade or nozzle or stator. Due to real-world effects, such as losses caused by surface friction, clearance gap flows, leakage, and vorticities caused by the fundamental nature of the rotating machine, non-uniformities develop in the impeller flow field. Such non-uniformities can be described in terms of non-uniformities in the magnitude and angle of fluid velocity in an impeller passage, with low-loss regions of the flow field being substantially aligned in a first direction, such as generally following an impeller passage direction, and other regions of the flow field being conveyed at various other angles and speeds up to and including normal to, and in the opposite direction of, the main impeller passage direction. Such off-angle flow field non-uniformities represent losses in the system and can cause further losses, such as flow instabilities, stall in a downstream element, backflow in the impeller, or large impeller exit aerodynamic blockage. The term primary flow and similar terms typically refer to the low-loss portion of an impeller flow field that is substantially aligned with the passage direction, and secondary flow and similar terms typically refer to other portions of the working fluid flow field and that may contain vorticity and appreciable losses.

Figure 1:
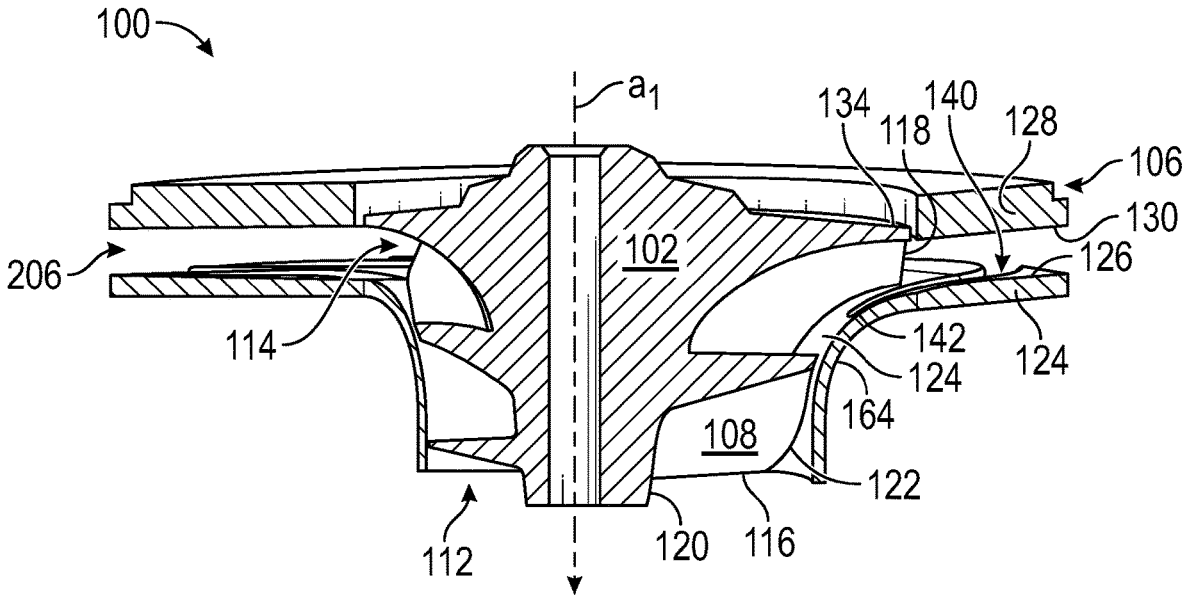
FIG. 1 is a cross sectional side view of a radial compressor with recessed channels in a hub and shroud surface of the compressor.
Figure 2:
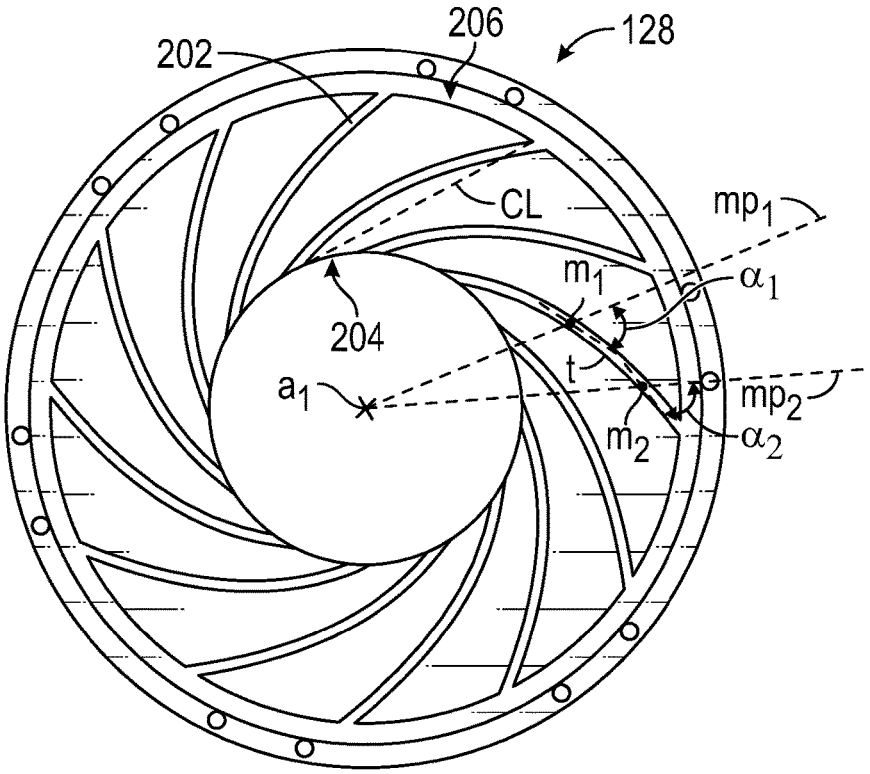
FIG. 2 is a front view of the diffuser back plate of the compressor of FIG. 1.

FIGS. 1 and 2 illustrate one example of a centrifugal compressor 100 that includes flow control structures made in accordance with the present disclosure. FIG. 1 is a cross-sectional side view and shows an impeller 102 rotatably disposed within an impeller shroud 164 and located upstream of a vaneless diffuser 106. Impeller 102 is configured to rotate about rotational axis a1, and includes a plurality of blades 108 (only one labeled), as well as an inlet 112 and an exit 114. Impeller blades 108 extend in a meridional direction between a leading edge 116 (only one labeled) and a trailing edge 118 (only one labeled) and extend in a spanwise direction between a hub 120 and a shroud side 122 of the impeller blade. Shroud 164 (sometimes also referred to as a casing) extends from impeller inlet 112 to exit 114 and defines a shroud surface 124 located adjacent shroud sides 122 of the impeller blades that, together with hub 120 defines an impeller passageway.

As is known in the art, impeller 102 is configured to convey a working fluid through the impeller passageway, compressing the working fluid and discharging the compressed working fluid through diffuser 106. Diffuser 106 includes a front plate 125 that defines a front surface 126 (sometimes also referred to as the shroud surface or shroud side of the diffuser) and a back plate 128 defining a back surface 130 (sometimes also referred to as the hub surface or hub side of the diffuser). Shroud surface 124 of shroud 164 and diffuser front surface 126 are substantially aligned and portions of hub 120 located at impeller exit 114 are aligned with diffuser back surface 130 as shown. In the illustrated example, impeller 102 is open, such that there is a small clearance between shroud sides 122 of blades 108 and shroud surface 124 and the impeller is configured to rotate relative to the stationary shroud 164. Similarly, there is a small clearance between a hub disk outer radius 134 and diffuser back plate 128, whereas shroud 164 and diffuser front plate 125 may not include any such gap and may form one continuous surface between the impeller and diffuser 106.

FIG. 2 is a front view of diffuser back plate 128 with the remaining components of the compressor 100 omitted. As shown in FIG. 2, diffuser back plate 128 includes a plurality of elongate flow-guiding channels 202 (only one labeled) located circumferentially around the back plate and extending generally in a flow-wise direction from diffuser inlet 204 to diffuser exit 206. Channels 202 have a meridional length that is defined as a length of a centerline of the channel extending from the beginning to the end of a given channel. In other examples, channels 202 may have a different length, for example they may not extend to the diffuser exit 206 and end upstream of the diffuser exit. In some examples, channels 202 may be designed and configured to communicate with flow-wise channels (not illustrated) located in impeller hub 120.

A curvature of channels 202 can be characterized by an angle profile, $\alpha(M)$, that defines an angle of the channel with respect to a meridional location, M, along the length of the channel as projected onto a meridional reference plane, MP, the angle, a, being the angle between a tangent line, t, to a centerline of the channel and the meridional reference plane, MP passing through the impeller axis of rotation, a1, that intersects the channel at meridional location M. FIG. 2 shows an angle $\alpha 1$ at meridional location M1 with respect to meridional reference plane MP1 extending through the channel at meridional location M1 and an angle $\alpha 2$ at meridional location M2 with respect to meridional reference plane MP2 extending through the channel at meridional location M2. Flow-guiding channels disclosed herein may have an angle, $\alpha(M)$, that varies along the length of the channel or a constant angle. In the illustrated example, channel 202 has a constant angle, $\alpha(M)$. As shown in FIG. 2, in a radial machine, such as compressor 100, a channel with a constant angle, $\alpha(M)$, has a curved spiral shape.

Channels 202 have a flow-wise length that is defined as a length of a centerline of the channel extending from the beginning to the end of a given channel and have a chord length, c, defined as a length of a chord line CL. In the illustrated example, channels 202 are disposed around a circumference of the diffuser 106 and are evenly spaced. A channel solidity may be defined as a ratio of chord length, c, to a spacing, s, between adjacent channels, for example, the spacing at the diffuser inlet or any other common reference point. Channels 202 are designed and configured to guide a portion of working fluid, such as a secondary flow portion of the working fluid, to reduce losses and improve the performance of the diffuser and compressor.

Referring again to FIG. 1, compressor 100 also includes a plurality of elongate flow-guiding channels 140 (only one illustrated) on a shroud side of the compressor. In the illustrated example, channels 140 extend from a beginning location 142 located in the impeller passageway that is upstream of the impeller blade trailing edges 118 and extend downstream generally in a flow-wise direction beyond the impeller exit 114 and into the diffuser 106 along front surface 126 of diffuser front plate 125 to the diffuser exit 114. Channels 140 in front plate 125 may have a similar configuration as channels 202 in back plate 128 but may have a different number of channels, channel angle, cross sectional shape or size to account for the difference in flow field characteristics between the hub and shroud surfaces. In other examples, channels 140 may have a different beginning or ending location, including a beginning location located anywhere along the impeller passageway between the impeller inlet 112 and exit 114 or the beginning location of one or more of the channels 140 may be located in the diffuser 106 and not located in the impeller at all. The ending location of the channels 202 and 140 may similarly have any of a number of locations along the length of the impeller or diffuser passageway. In other examples, compressor 100 may only include recessed flow-wise channels along the shroud-side of the machine (e.g., only channels 140) and not include channels along the hub-side of the machine (e.g., not include channels 202) or vice versa (only hub-side channels and not shroud-side channels).

Various examples of prior art flow guiding channels are disclosed in U.S. Pat. No. 9,845,810, titled Flow Control Structures for Turbomachines and Methods of Designing the Same (the '810 patent), the contents of which are incorporated by reference herein in their entirety. The various features and combinations of flow guiding structures, including recessed flow guiding channels may be incorporated with the features described and illustrated in the present disclosure.

Recent research by the present inventor indicates the angle, $\alpha(M)$, of flow-wise channels, such as channels 202 and 140, may have a significant influence on the performance of the turbomachine. In some examples, to achieve a desired performance characteristic, such as a target pressure vs. flow characteristic, a flow-wise curvature or flow-wise angle profile of one or more of the channels may be set near an estimated, measured, or calculated working fluid flow angle, for example, a flow angle at a particular meridional and spanwise location in the machine when the turbomachine is operating at a particular operating point, such as operating at a stage choke point. For example, one or more recessed flow-wise channels, such as channels 202 and/or 140 may have an angle, $\alpha(M)$, along an entire length of the channel, or along a portion thereof, that is approximately the same as, or in some examples, approximately the same as or less than, a flow angle of the working fluid near the shroud wall surface or hub wall surface when the turbomachine is operating at a stage choke point. In some examples, one or more channels may have an angle, $\alpha(M)$, that is approximately the same as or less than, a flow angle of the working fluid near the shroud wall surface or hub wall surface when the turbomachine is operating at a mass flow rate that is at least 90% of a mass flow rate at a stage choke point, and in some examples, a mass flow rate that is at least 80% of a mass flow rate at a stage choke point, and in some examples, a mass flow rate that is at least 70% of a mass flow rate at a stage choke point, and in some examples, a mass flow rate that is at least 60% of a mass flow rate at a stage choke point. In some examples, one or more channels may have an angle, $\alpha(M)$, that is approximately the same as or less than, a flow angle of the working fluid near the shroud wall surface or hub wall surface when the turbomachine is operating at +/−15% of a mass flow rate at a best efficiency point, +/−15% of a mass flow rate at a choke point, such as a stage choke point, 20%-80% of a mass flow rate at a best efficiency point, 20%-80% of a mass flow rate at a choke point, a mass flow rate between a best efficiency point and a choke point, for example, approximately halfway therebetween.

As described more below, in some examples, more than one set of channels having different angle profiles may be included on a hub or shroud side of a turbomachine to optimize performance over a wide range of operating conditions. In yet other examples, a solidity of the channels may be selected to optimize performance. In yet other examples, edge features along the length of the channels may be utilized to improve the effectiveness of the channels. In yet other examples, vanes, such as full or partial height vanes may be included to improve the performance of the recessed flow-wise channels. In some examples, a cross sectional area may be configured and dimensioned to prevent choking in the channels.

Figure 3:
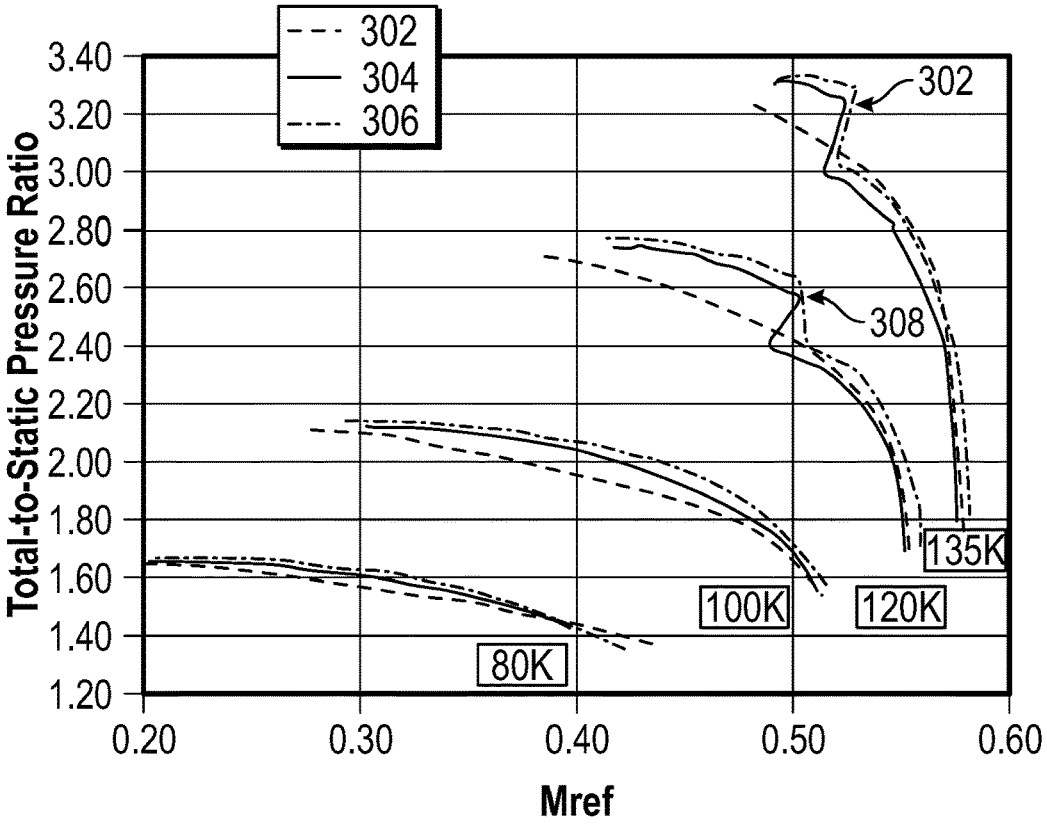
FIG. 3 shows the measured performance of three different vaneless diffusers coupled to a compressor.
Figure 4:
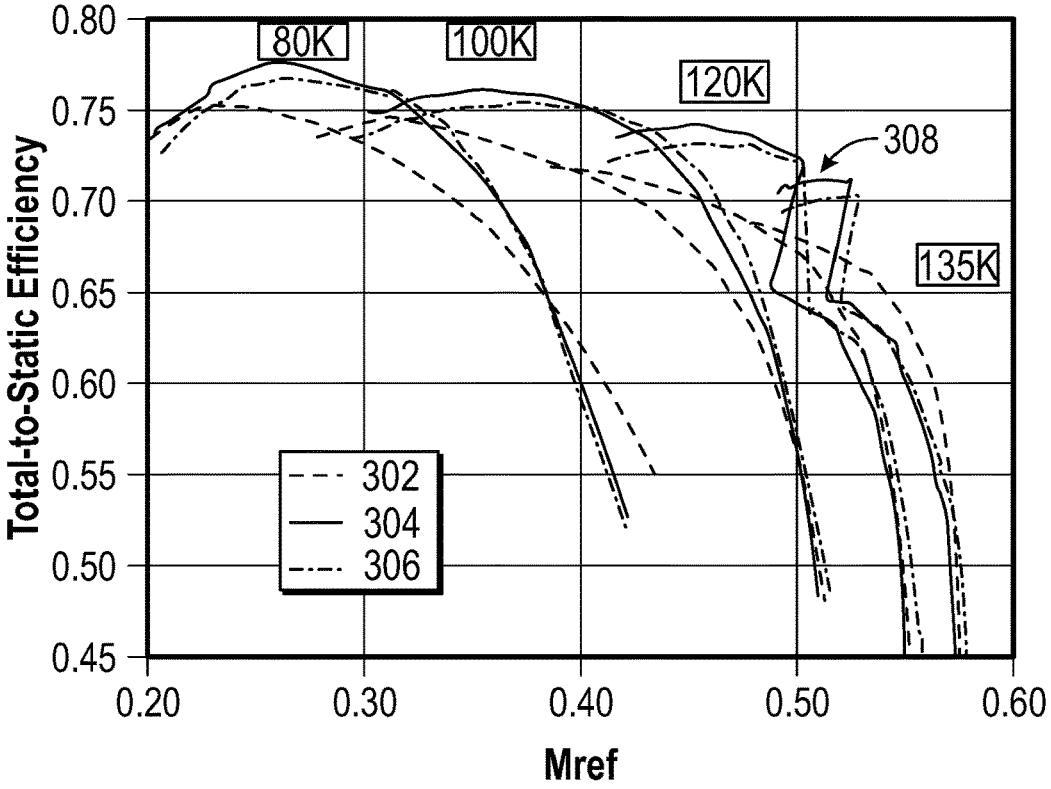
FIG. 4 shows the measured performance of three different vaneless diffusers coupled to a compressor.

FIGS. 3 and 4 show the measured performance of three different vaneless diffusers coupled to a compressor: (1) curves 302 representing test data from a baseline vaneless diffuser that does not include recessed channels in the hub or shroud (2) curves 304 representing test data from a vaneless diffuser that is similar to diffuser 106 and includes recessed flow-wise channels in both the front and rear plates of the diffuser that are similar to channels 202 and 140 but the channels do not extend upstream of the diffuser into the impeller; and (3) curves 306 representing test data from the same diffuser as curve 304 except with the hub and shroud channels circumferentially offset from each other and also the shroud side channels were similar to channels 140 and extended upstream into the impeller.

FIG. 3 illustrates total-to-static pressure with respect to a non-dimensional mass flow rate for four different impeller speeds (80,000 RPM-135,000 RPM). FIG. 4 illustrates total-to-static efficiency with respect to a non-dimensional mass flow rate for the same four impeller speeds (80,000 RPM-135,000 RPM). As shown in FIGS. 3 and 4, the performance of the machines that include flow-wise channels (curves 304 and 306) is considerably better than the performance of the baseline machine without channels (curve 302) at low flow, achieving a record high level of performance. At higher flow rates at high speeds, however, there is a drop 308 in performance with the pressure and efficiency of the two machines with channels (curves 304 and 306) being approximately the same as the performance of the baseline case (curves 302). In other words, the performance benefit of the recessed flow-wise channels seems to be lost at higher flow rates (above about Mref=0.5) and higher speeds (125k and 135k speed lines) and/or the effectiveness of the channels at improving the performance of the machine appears to decrease. This trend was found whether operating from high flow to low flow (i.e. from right to left on the line), or the opposite, operating from low flow to high flow. A small variance was observed in the mass flow rate where the drop 308 in performance occurs in the 120k and 135k speed lines, depending on the direction of operation. The present disclosure includes structures that are designed and configured to minimize or eliminate the observed drop 308 in performance and provide flow control structures, including recessed flow-wise channels, that are designed to provide improved performance at high flowrates and speeds as well as lower flowrates and speeds. As discussed more below, the drop in performance at higher flowrates may be caused by a decrease in the extent of coupling between the working fluid in the diffuser and the recessed channels, where a change in working fluid flow angle causes some portion of the working fluid to bypass the channels, causing a drop in compressor performance and efficiency. The drop in performance in some cases may also be caused by choked flow in one or more of the recessed channels at higher flowrates.

Figure 5:
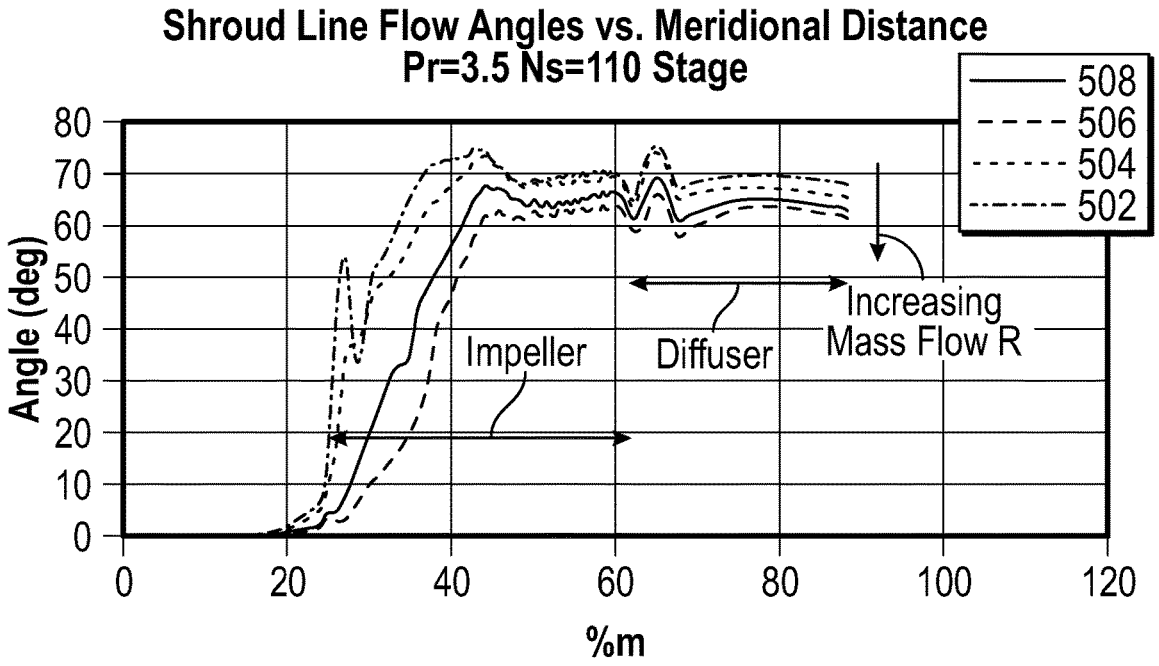
FIG. 5 shows a computed average flow angle for stream tubes adjacent the shroud surface as a function of meridional location in a centrifugal compressor coupled to a vaneless diffuser.

FIG. 5 shows a computed average flow angle for stream tubes adjacent the shroud surface as a function of meridional location in a centrifugal compressor coupled to a vaneless diffuser. The calculations were performed with a computational fluid dynamics model of a centrifugal compressor and vanless diffuser. Recessed flow-wise channels were not included in the model. The flow angles are averaged in the circumferential direction around the machine, thereby averaging all impeller blade to blade variations into one representative angle. FIG. 5 shows average flow angle versus meridional location for four different mass flow rates each with the impeller operating at 135,000 RPM, with curve 502 illustrating computed flow angles for the lowest mass flow condition and curve 506 illustrating angles for the highest mass flow condition. The angles are taken with respect to a meridional reference plane in the same manner as angle $\alpha(M)$. Thus, higher angles from a radial reference line indicate a more tangential flow which is well known in the art to be closer to a stability limit and lower angles indicate a more radial flow. The impeller starts at about 25% meridional distance (M) and ends at about 62% meridional distance in this figure. The diffuser extends from about 62% to about 88% meridional distance. Curve 502 is for the lowest flow rate condition and occurs just before stage stall or system surge; curve 506 is the lowest trace for the highest flowrate and occurs just below the choke limit level for the impeller. These traces are taken just off the adjacent wall (cover); for the shroud, the trace is just past the impeller clearance gap gridding. As is evident from FIG. 5, the flow angles become more radial (lower angles) as the mass flow rate increases. As noted above in connection with FIGS. 3 and 4, a performance drop is also observed at higher flowrates. Thus, as described more below, the decreasing flow angles as flow rates increase may result in the flow eventually becoming more radial than the recessed channels, thereby preventing the flow from entering the channels and reducing the effect the channels are having on the performance of the machine.

Figure 6:
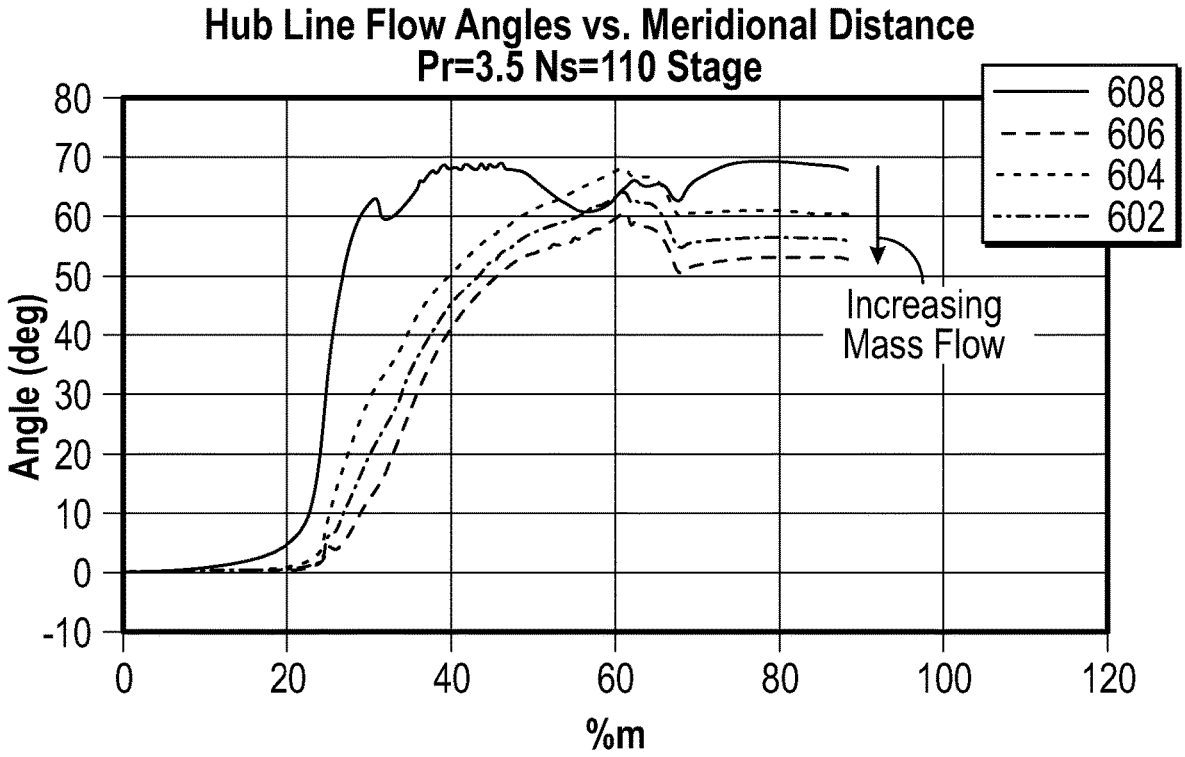
FIG. 6 shows a computed average flow angle for stream tubes adjacent the hub surface as a function of meridional location in a centrifugal compressor coupled to a vaneless diffuser.
Figure 7:
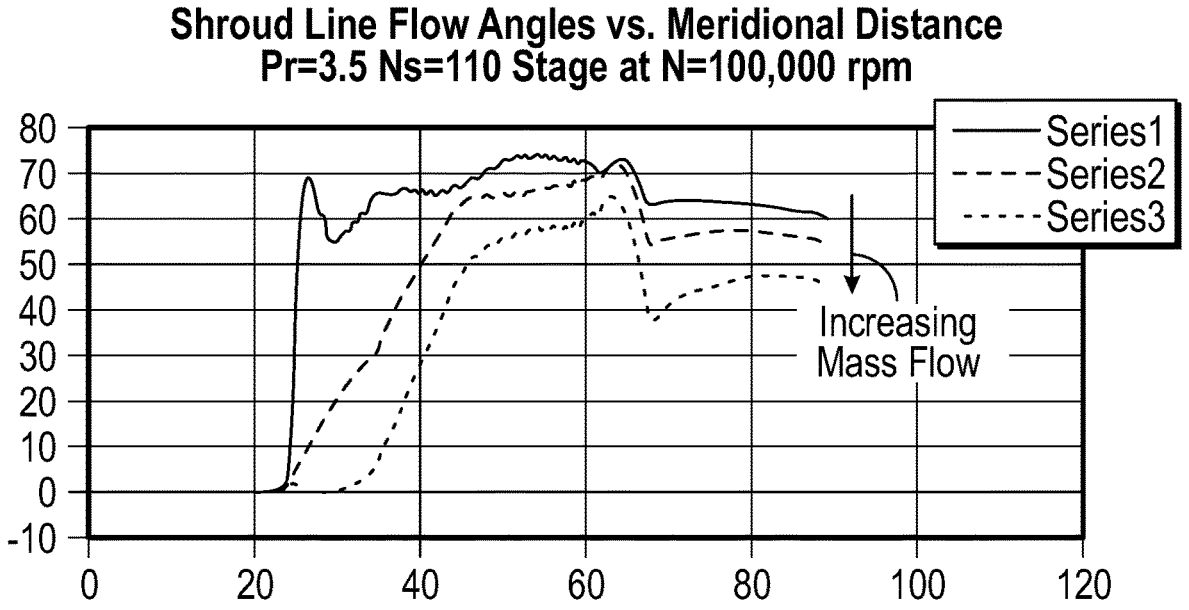
FIG. 7 shows a computed average flow angle for stream tubes adjacent the shroud surface as a function of meridional location in a centrifugal compressor coupled to a vaneless diffuser.
Figure 8:
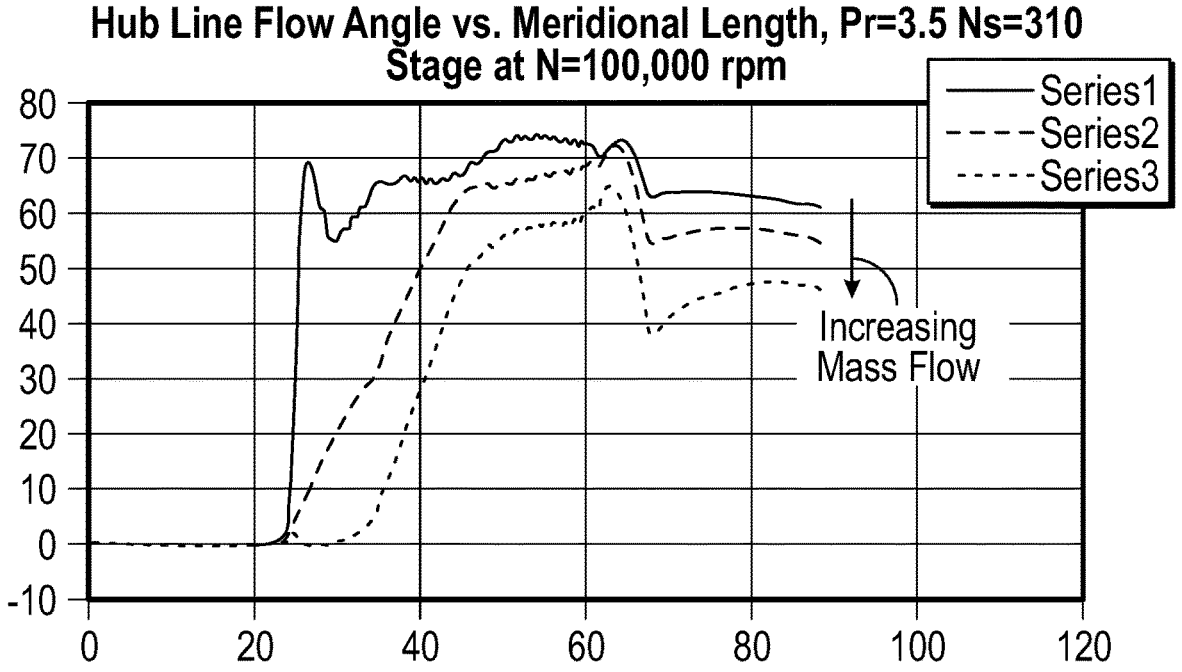
FIG. 8 shows a computed average flow angle for stream tubes adjacent the hub surface as a function of meridional location in a centrifugal compressor coupled to a vaneless diffuser.
Figure 9:
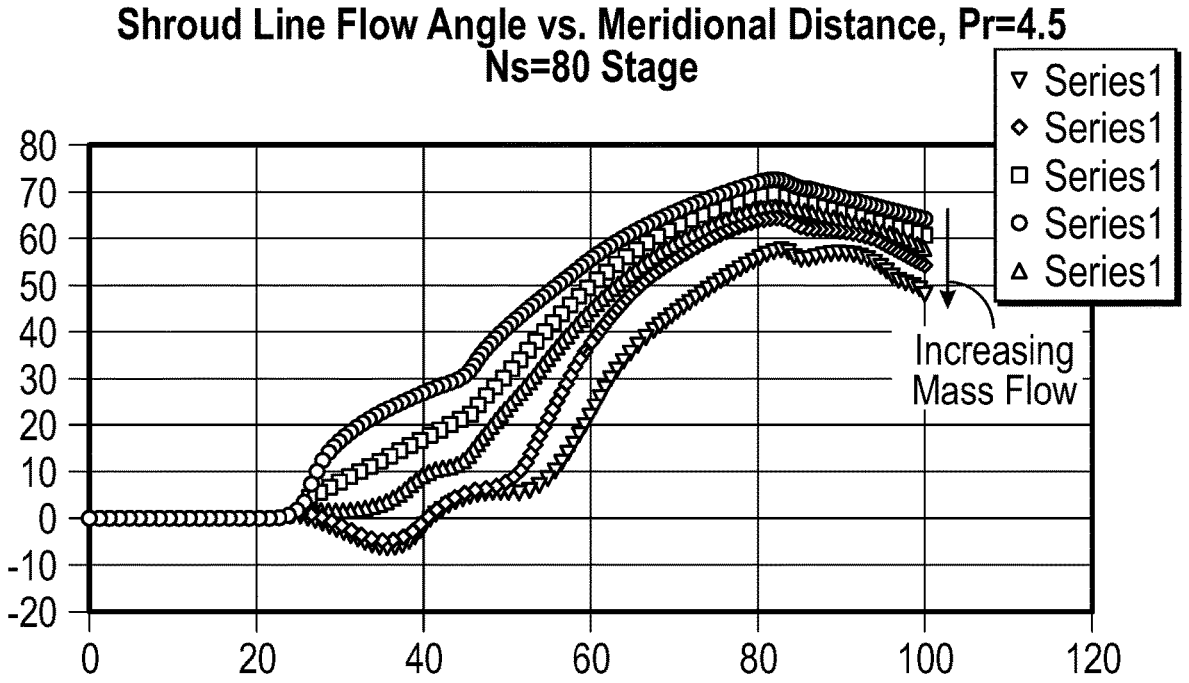
FIG. 9 shows a computed average flow angle for stream tubes adjacent the shroud surface as a function of meridional location in a centrifugal compressor coupled to a vaneless diffuser.

FIG. 6 shows the computed circumferentially averaged flow angles along the hub for the same CFD model as was used for FIG. 5 and same four operating conditions as shown in FIG. 5 with curve 608 being the lowest flow condition and curve 606 being the highest flow condition. FIGS. 7 and 8 illustrate calculated flow angle data along the shroud (FIG. 7) and hub (FIG. 8) as a function of meridional location and flow rate at a lower impeller speed of 100,000 RPM. At the lower rotational speed, along the shroud (FIG. 7), the diffuser time-averaged (blade to blade variations) flow angles are in the range of 40 to 73 degrees from the meridional or radial direction vs. a range of 58 to 75 degrees on the N=135,000 rpm line (FIG. 5). Hence the lower speed line shows steeper (more radial, lower angle) streamlines than the higher speed line cases. For the hub (FIG. 8) the angles are not much reduced from those of the shroud side compared with the higher speed line operation. FIG. 9 illustrates an alternate example for a Pr=4.5 stage, vaneless diffuser and without recessed channels in the hub or shroud, provided as another angle of ranges of average flow angles that are in the same approximate range as FIGS. 5 and 7.

Figure 10:
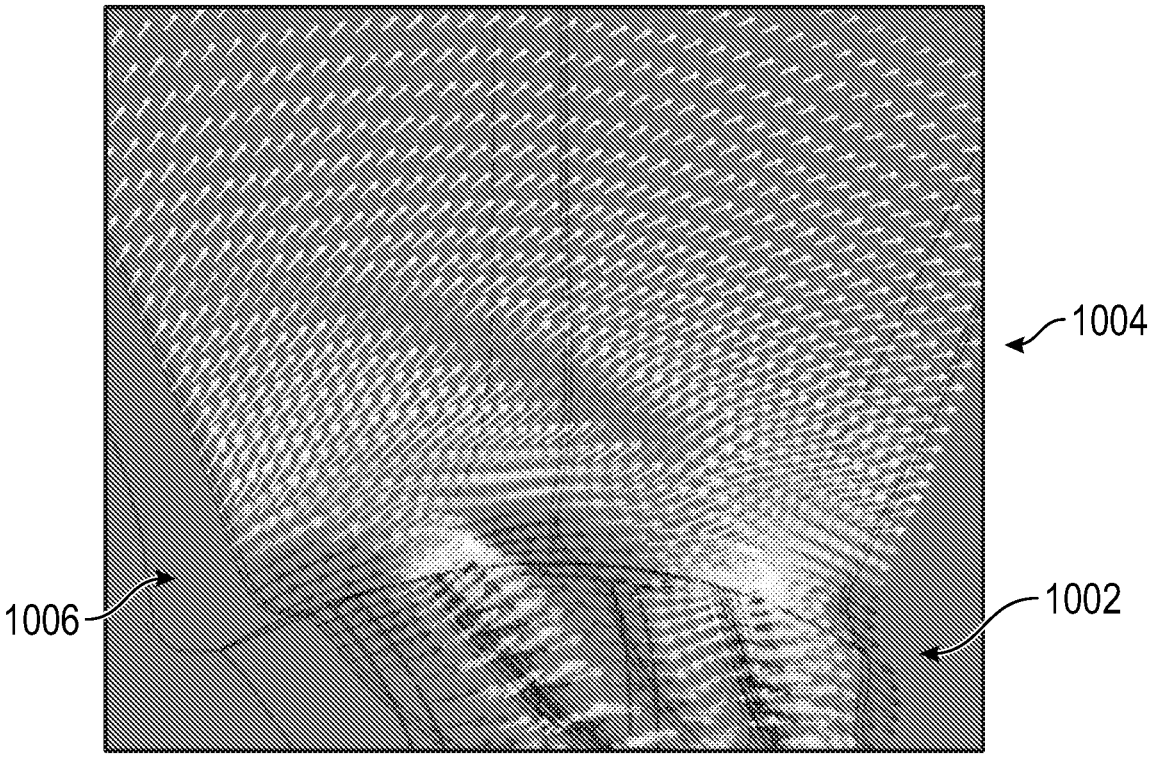
FIG. 10 is an example streamline plot generated by a CFD program for 0.5 lbm/sec flow rate, 100,000 rpm, shroud side case and shows a portion of an impeller and diffuser.

FIG. 10 is an example streamline plot generated by a computational fluids model, such as a computational fluid dynamics (CFD) program for 0.5 lbm/sec flow rate, 100,000 rpm, shroud side case and shows a portion of an impeller 1002 and diffuser 1004. The arrows represent flow field streamline vectors with the angle of the arrow indicating flow direction and the length of the arrow indicating magnitude of flow velocity. Streamline plots such as the one shown in FIG. 10 reveal much more complexity in the flow field than the blade-to-blade averaged flow angles shown in FIGS. 5-9. In the illustrated example, the vectors have a more tangential direction (higher flow angle from a meridional reference plane) in the region of the impeller exit/diffuser inlet 1006 and a more radial direction (lower flow angle) downstream of the diffuser inlet.

Figure 11:
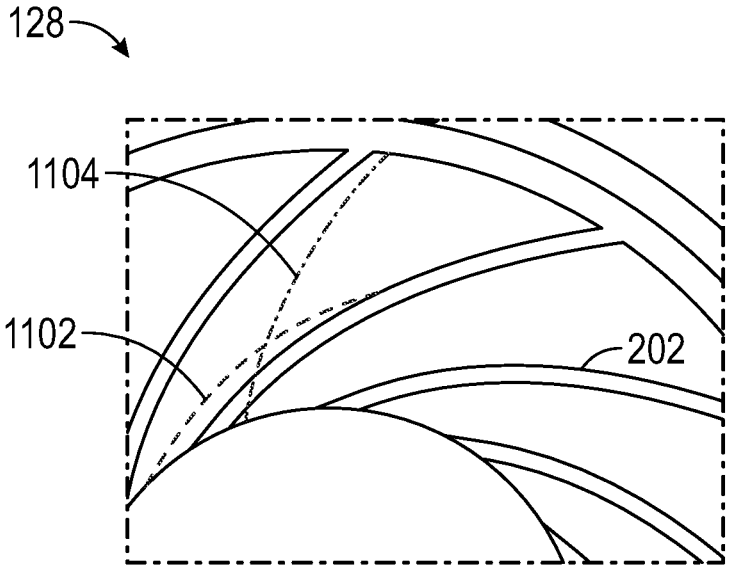
FIG. 11 shows a portion of diffuser back plate and also conceptually shows two example flow streamlines at differing flow angles.

FIG. 11 shows a portion of diffuser back plate 128 (see also FIG. 2) and also conceptually shows two example flow streamlines, including a more tangential, high-angle streamline 1102 that, as explained above in connection with FIGS. 5-9, may be more prevalent at lower flowrates, and a more radial, low-angle streamline 1104 that may be more prevalent at higher flowrates. As can be seem in FIG. 11, the angle of channels 202 (only one labeled) may have an impact on whether the working fluid enters the channels. In the illustrated example, the channels 202 have a relatively high angle more suited for capturing the more tangential flow but at the lower angle there is a higher likelihood the lower angle more radial flow (e.g. low-angle streamline 1104) may skip over or completely miss the channels 202 as shown in FIG. 11, thereby reducing the effectiveness of the channels. Such a phenomena may explain the drop 308 in performance shown in FIGS. 3 and 4 and described above.

Referring again to FIG. 5, if, for example, the angle of the recessed channels fell in the middle of the computed band of flow angles for the diffuser, for example, a channel angle, $\alpha(M)$, of approximately 65 degrees, the flow may have two different modes of behavior. Flow states at the lower angles (steeper streamlines, more radial flow), which occur for higher flow rate compressor or pump performance, may be more radial than the trajectory of the channels such that the flow may skip right over and bypass the channels as conceptually illustrated by streamline 1104 in FIG. 11, or miss the channel completely, resulting in little flow being captured in the channel itself. Comparing FIG. 6 to FIG. 5, the computed flow angles on the hub have a minimum flow angle at the high flow condition of about 50 degrees, which is about 10 degrees lower (more radial) than on the shroud. In one example, to avoid the two-mode operation and drop in performance at higher flow rates described above in connection with FIGS. 3 and 4, and to keep the channels working well at all flow rates, the recessed channels may be set at a sufficiently low angle level (hence more radial) to permit complete channel operation at all flow rates along the operating characteristic. For example, in the case shown in FIGS. 5 and 6, for the front (shroud) side, FIG. 5 shows about a 55-60 degree angle channel may be sufficient (approximately the same or 5 degrees less than the lowest flow angles associated with the most radial flow at the higher flowrates); for the hub or rear side, one might use about 50 degrees.

Referring again to FIG. 10, the vector streamline plots suggest a more tailored approach to channel curvature may be warranted in some cases. A bird's eye view of FIG. 10 may suggest a straight channel, or a log spiral shaped channel, at about 40 degrees to accomplish optimum interception of the streamlines by the channels because the flow angles appear to approach roughly a 45 degree angle downstream of the impeller exit, but a higher angle (more tangential) might well be preferred at impeller discharge/diffuser inlet for both fairing purposes (e.g. from impeller cover channels) and to ease entry to the channel from the initial tangential high angle flows at the impeller blade trailing edges. Thus, a channel with an angle that varies as a function of meridional location with a higher angle in the region of the diffuser inlet and a lower angle downstream of the diffuser inlet.

Figure 12:
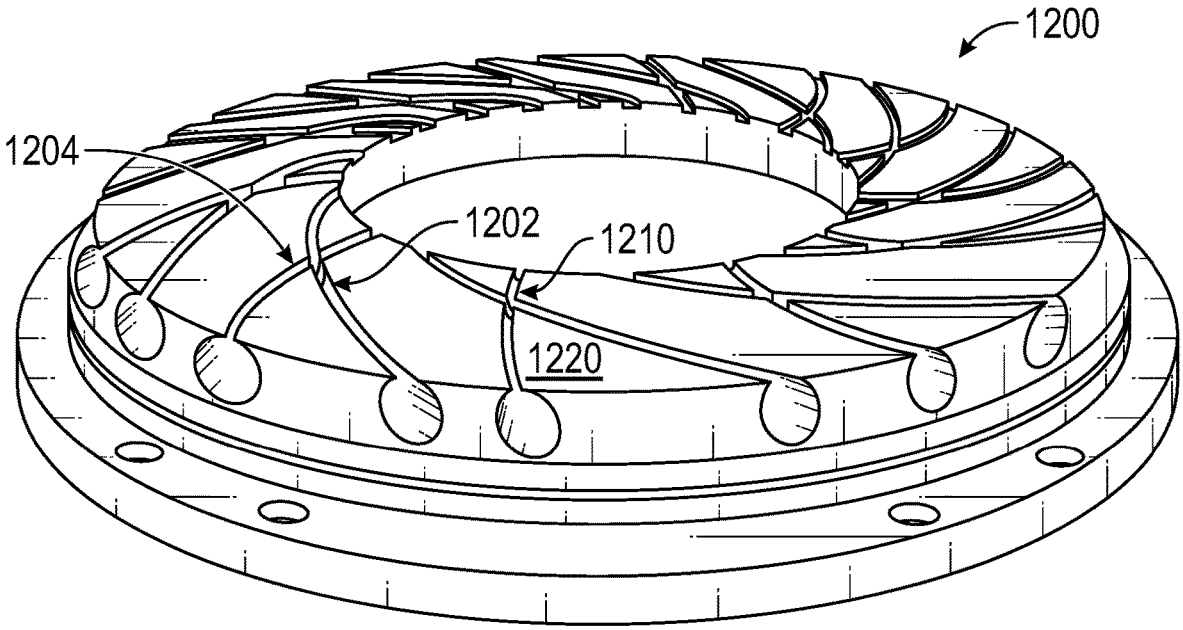
FIG. 12 shows a diffuser plate that includes a plurality of sets of channels having different channel angles.
Figure 13:
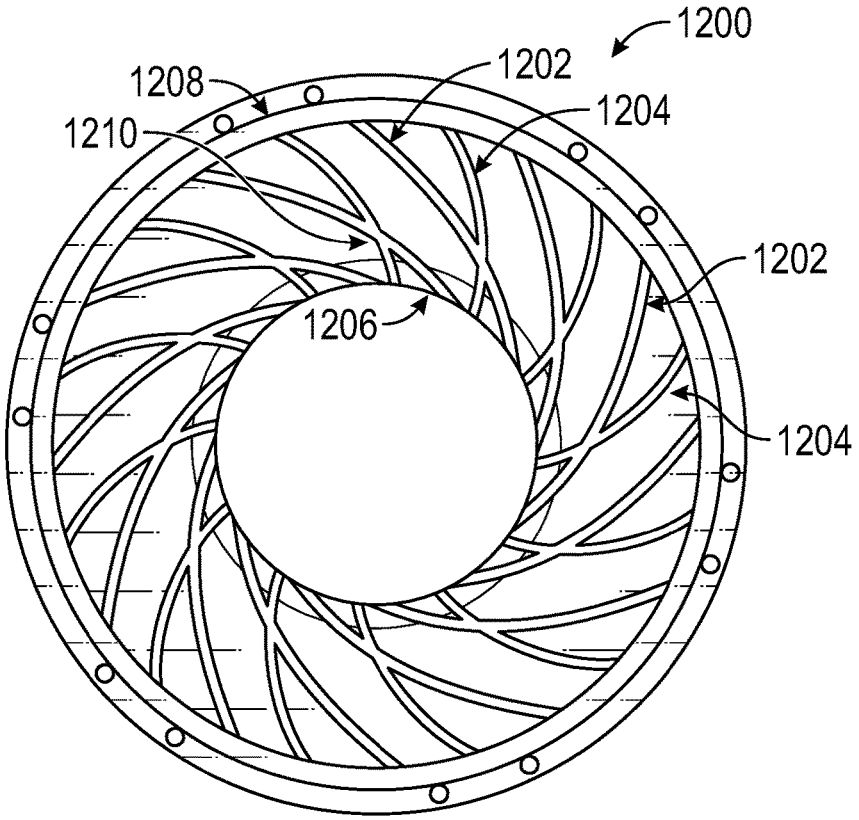
FIG. 13 is a front view of the diffuser plate of FIG. 12.

FIGS. 12 and 13 illustrate another example of a diffuser plate 1200 that can be used for either the front or back plate of a diffuser passage and that includes a plurality of sets of channels, here two sets—channels 1202, and channels 1204 (only one of each labeled). Diffuser plate 1200 is designed and configured to minimize or eliminate the performance drop that may occur across a range of flowrates by designing and selecting different angle profiles for the two sets of channels 1202, 1204 to capture different working fluid flow angles. In the illustrated example, channels 1202 have a higher angle and are more tangential with respect to a meridional reference plane and may, therefore, be more effective at lower mass flow rates where, as described above in connection with FIGS. 5-9, the flow angles tend to be greater and more tangential. Channels 1204 have a lower angle and are more radial with respect to a meridional reference plane and may, therefore, be more effective at higher mass flow rates where the flow angles tend to be lower and more radial. Therefore, lower angle channels 1204 may be incorporated into the front or back plate of a vaned or vaneless diffuser to eliminate the performance drop 308 observed at higher mass flow rates (see FIGS. 3 and 4).

In some examples, channels 1202 have an angle profile, $\alpha(M)$, over all or a portion of the channels that is greater than or equal to an estimated, calculated, measured, or otherwise determined maximum working fluid flow angle over a corresponding region of the turbomachine at a minimum mass flow rate operating point. In some examples, channels 1202 have an angle, $\alpha(M)$, that is within +/−5% of the maximum working fluid flow angle at the minimum mass flow rate operating point, and in some examples, within +/−10% of the maximum working fluid flow angle, and in some examples, within +/−15% of the maximum working fluid flow angle, and in some examples, within +/−20% of the maximum working fluid flow angle, and in some examples, within +/−25% of the maximum working fluid flow angle.

In some examples, channels 1204 have an angle profile, $\alpha(M)$, over all or a portion of the channels that is less than or equal to an estimated, calculated, measured, or otherwise determined minimum working fluid flow angle over a corresponding region of the turbomachine at a maximum mass flow rate operating point. In some examples, channels 1204 have an angle, $\alpha(M)$, that is within +/−5% of the minimum working fluid flow angle at the maximum mass flow rate operating point, and in some examples, within +/−10% of the minimum working fluid flow angle, and in some examples, within +/−15% of the minimum working fluid flow angle, and in some examples, within +/−20% of the minimum working fluid flow angle, and in some examples, within +/−25% of the minimum working fluid flow angle.

Diffuser plate 1200 includes a plurality of channels including a plurality of first channels 1202 and a plurality of second channels 1204, wherein an angle of the first channels 1202 with respect to meridional location along the channel, $\alpha 1(M)$, is greater than an angle of the second channels with respect to meridional location along the channel, $\alpha 2(M)$, for all values of M, in other words, for all meridional locations along the length of the diffuser plate 1200 between the inlet and the exit of the diffuser. The angles, $\alpha 1(M)$, $\alpha 2(M)$, are an angle of a corresponding one of the first or second channels with respect to a meridional reference plane passing through the channel at a meridional location M along a length of the channel.

In the illustrated example, both channels 1202 and 1204 have a length that extends across the diffuser from the diffuser inlet 1206 to the diffuser outlet 1208 and have an area schedule and angle profile that results in each of the channels from each set, 1202, 1204, intersecting one of the channels from the other set at intersection points 1210, where the meridional location of the intersection point may be anywhere along the length of the diffuser. For example, if 0% M is the diffuser inlet and 100% M is the diffuser outlet, the intersection points 1210 may have a meridional location in the range of 1% M-99% M, and in some examples, 5% M-95% M, and in some examples, 10% M-90% M, and in some examples, 20% M-80% M, and in some examples, 30% M-70% M, and in some examples, 40% M-60% M, and in some examples, 5% M-50% M, and in some examples, 50% M-90% M.

In the illustrated example, as best seen in FIG. 12, channels 1202 and 1204 each have an enlarged submerged cross section located below diffuser surface 1220 designed to accommodate and diffuse a sufficient volumetric flow at a particular design condition. In one example, both channels 1202 and 1204 may have substantially the same cross sectional area schedule, where the cross sectional area of each channel may increase with increasing meridional location to accommodate increasing amounts of diffusing flow. In other examples, the cross sectional shape or area of the two sets of channels may be different, for example, lower angle channels 1204 may be shallower and have a smaller cross sectional area proximate the diffuser inlet because the flow in the area of the diffuser inlet is understood to be more tangential, but channels 1204 may have a deeper and larger cross sectional area and/or a wider width at the diffuser plate surface farther downstream where flow angles are lower (more radial).

In the illustrated example, there are an equal number of channels 1202 and 1204, here, 12 each. In other examples, there may be different numbers of each. For example, one set of channels may have a smaller number than the other, such as 10%-20% less, or 20%-30% less, or 30%-40% less, or 50%-60% less, or 60%-70% less, or 80%-90% less channels, or 10%-60% less channels. By way of non-limiting example, in another implementation diffuser plate 1200 may include 12 of the higher angle channels 1202 as shown in FIG. 12 but only 6 of the lower angle channels 1204, with the 6 channels 1204 evenly spaced around the circumference of the diffuser because the lower-angle channels may have a greater influence on performance by curing low-angle secondary flow that is detrimental to performance.

Figure 14:
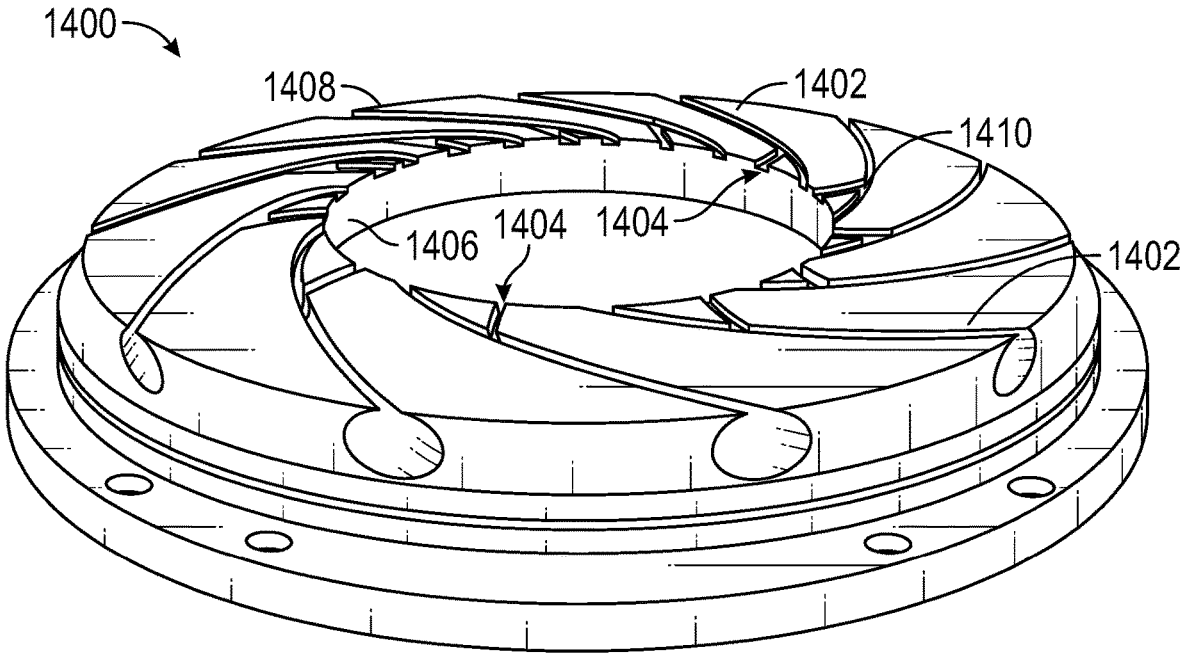
FIG. 14 shows another example of a diffuser plate that includes a plurality of sets of channels having different channel angles.
Figure 15:
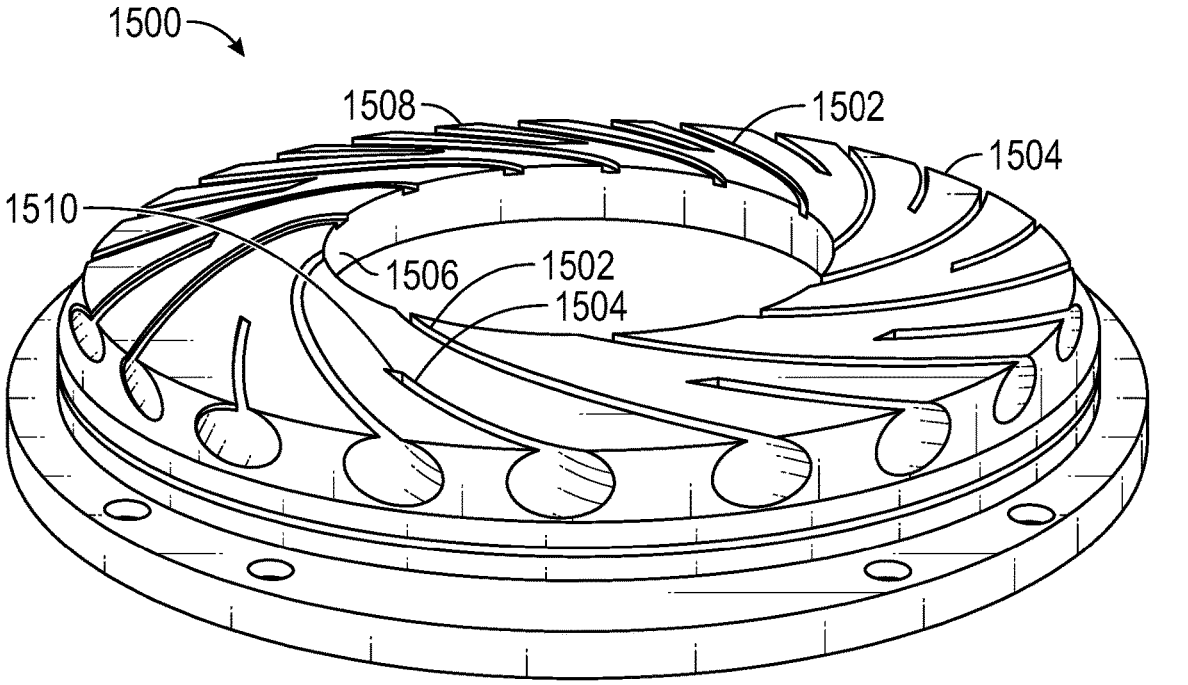
FIG. 15 shows another example of a diffuser plate that includes a plurality of sets of channels having different channel angles.
Figure 16:
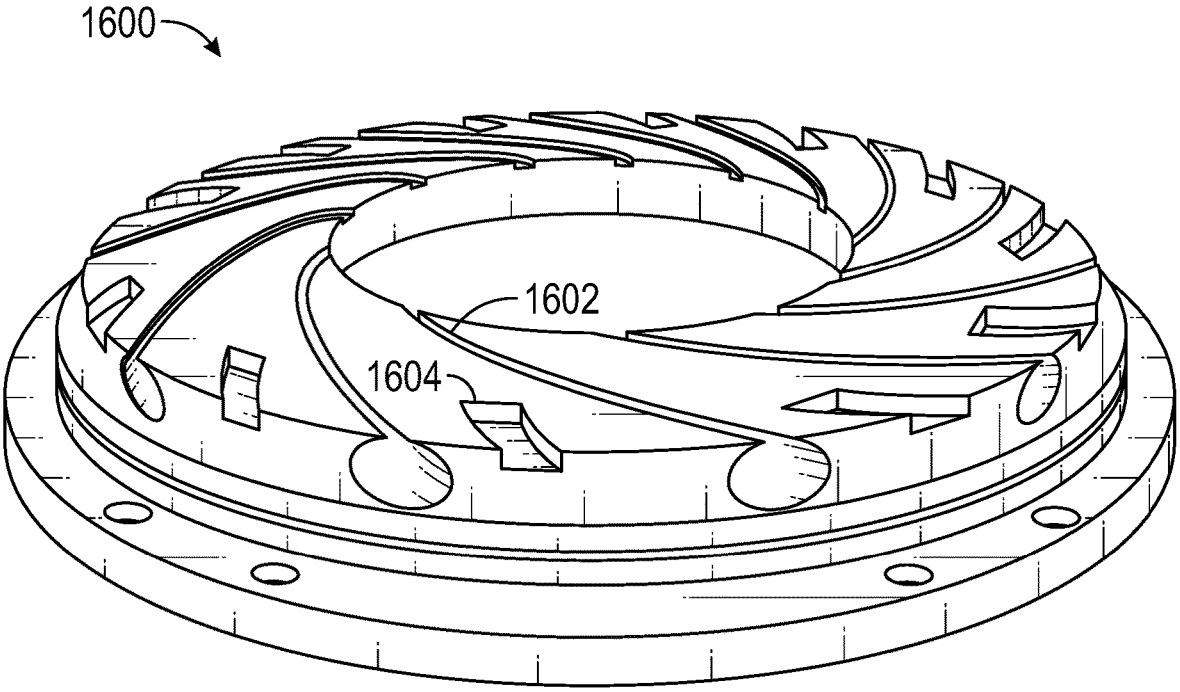
FIG. 16 shows another example of a diffuser plate that includes a plurality of sets of channels having different channel angles.

In the example shown in FIG. 12, both sets of channels 1202 and 1204 have a length that extends across the diffuser from the diffuser inlet 1206 to the diffuser outlet 1208. In other examples, rather than both sets of channels extending across an entire length of the diffuser, channels 1202 and 1204 may have different beginning locations and/or ending locations. For example one of the sets of channels 1202, 1204 may extend across an entire length of the diffuser while the other may be located along only a portion of the diffuser. FIGS. 14-16 illustrate two such examples, with FIG. 14 showing a diffuser plate 1400 that includes a first set of channels 1402 of flow-wise channels (only two labeled) having a first angle profile and a second set of channels 1404 of flow-wise channels (only two labeled) having a second angle profile that is different than the first angle profile. In the illustrated example, channels 1402 have a greater angle with respect to a meridional reference plane and are designed and configured to couple to and capture more tangential higher-angle flow typically found at lower flow rates. Channels 1404 have a smaller angle with respect to a meridional reference plane and are designed and configured to couple to and capture more radial lower angle flow typically found at higher flow rates. In the illustrated example, the higher-angle channels 1402 extend across an entire length of the diffuser from diffuser inlet 1406 to diffuser outlet 1408 whereas the lower-angle channels 1404 do not extend across the entire diffuser and instead are only located in an inlet region of the diffuser, with the channels extending from the diffuser inlet 1406 to intersection points 1410 (only one labeled) where they each intersect and are in fluid communication with a corresponding one of the lower-angle channels 1404.

FIG. 15 shows another example implementation of a diffuser plate 1500 that includes a first set of flow-wise channels 1502 (only two labeled) having a first angle profile and a second set of flow-wise channels 1504 (only two labeled) having a second angle profile that is different than the first angle profile. In the illustrated example, channels 1502 have a greater angle with respect to a meridional reference plane and are designed and configured to couple to and capture more tangential higher angle flow typically found at lower flow rates. Channels 1504 have a smaller angle with respect to a meridional reference plane and are designed and configured to couple to and capture more radial lower angle flow typically found at higher flow rates. In the illustrated example, the higher-angle channels 1502 extend across an entire length of the diffuser from diffuser inlet 1506 to diffuser exit 1508 whereas the lower-angle channels 1504 do not extend across the entire diffuser and instead are only located in a downstream region of the diffuser, with the channels extending from an intermediate location to diffuser exit 1508. As noted above in connection with FIG. 10, CFD calculations indicate flow angles, by design, can be highly tangential at the diffuser inlet and become more radial downstream. Thus, lower angle channels 1504 may be designed, configured, and selectively located in a downstream portion of the diffuser to capture the higher angle flow and have a beginning location 1510 that is in a region where calculated flow angles fall below a threshold value, for example, less than 40-60 degrees, and in some examples, less than 40-50 degrees from a meridional reference plane.

FIG. 16 illustrates another example diffuser plate 1600 that is similar to diffuser plate 1500, including a first set of higher angle channels 1602 that extend across an entire length of the diffuser and a second set of lower angle channels 1604 that are located in a downstream portion of the diffuser passageway. Unlike diffuser plate 1500, where channels 1502 and 1504 have similar cross sectional shapes and area profiles, channels 1604 have a shallower depth and different cross sectional area than channels 1602 and are designed to capture a smaller volume of fluid flow than channels 1602. In the examples shown in FIGS. 14-16 each set of channels includes the same number of channels. In other implementations, one set of channels may have a smaller number than the other, such as 10%-20% less, or 20%-30% less, or 30%-40% less, or 50%-60% less, or 60%-70% less, or 80%-90% less channels, or 10%-60% less channels. In the illustrated examples, the higher-angle channels extend across the entire length of the diffuser, while in other implementations they may not, having beginning and ending locations at other points along the diffuser. Similarly, in the illustrated examples, the lower-angle channels extend across only a portion of the diffuser, while in other implementations they may extend across an entire length of the diffuser. In other examples, a turbomachine may have three or more sets of channels, the channels in each set having a different angle profile than the channels in the other sets, the number of channels in each set may be the same or different, and the channels in each set may extend across an entire length of the diffuser or only a portion of the diffuser, may extend upstream into the impeller, and may be located on either the hub or shroud side of the turbomachine or on both sides.

Figure 17:
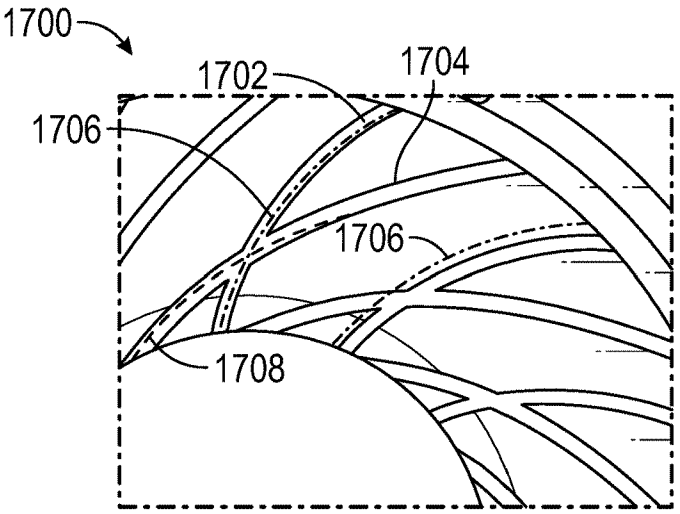
FIG. 17 illustrates a diffuser plate with two sets of channels and also conceptually illustrates a low-angle streamline and a high angle streamline.

FIG. 17 illustrates a diffuser plate 1700 with two sets of channels 1702, 1704 and also conceptually illustrates a low-angle streamline 1706 and a high angle streamline 1708. As shown in FIG. 17, by having two sets of channels with different angle profiles, both the higher angle flow and the lower angle flow may be captured by the channels 1702, 1704 and redirected in a preferred direction, thereby improving the performance of the turbomachine across a wide range of flow rates and operating conditions.

Figure 18:
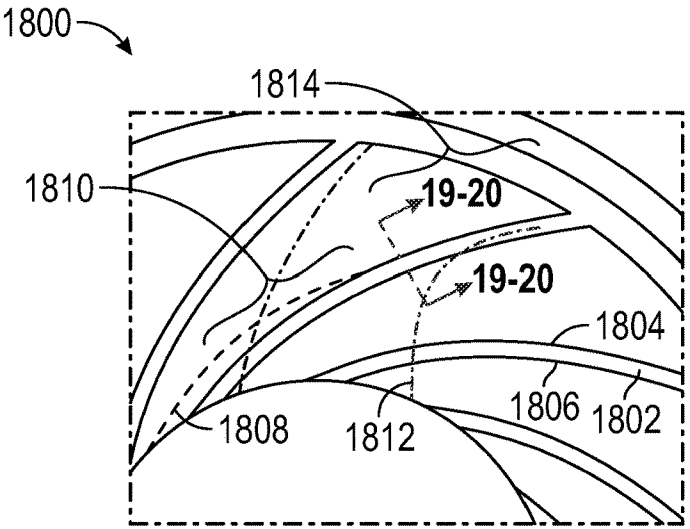
FIGS. 18-20 illustrate example transitional edge features that may be incorporated into recessed channels.
Figure 19:
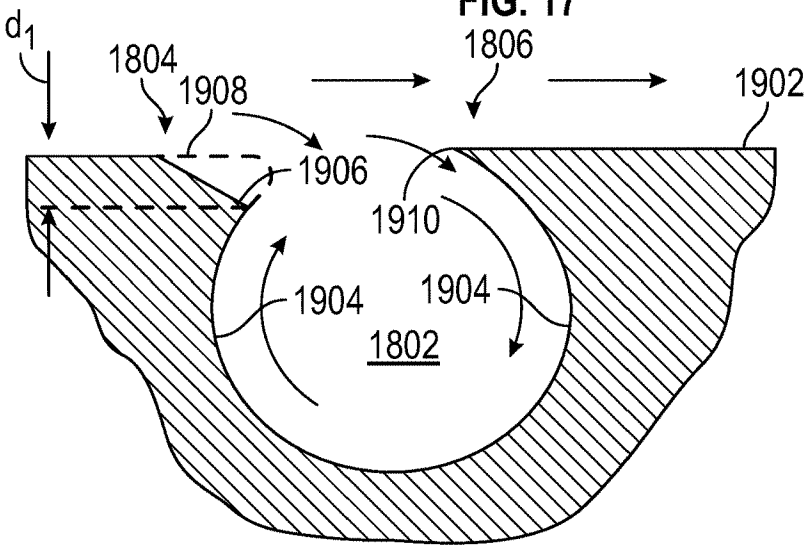
Figure 20:
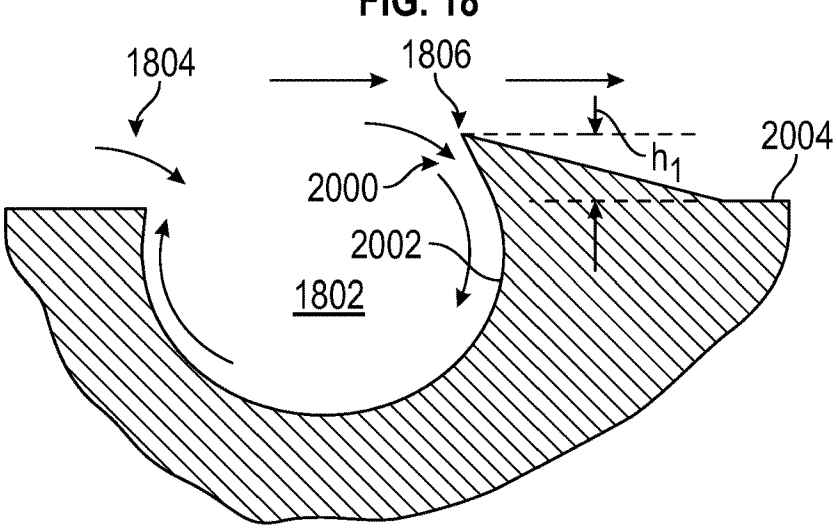

FIGS. 18-20 illustrate example transitional edge features that may be incorporated into any of the recessed channels disclosed herein to increase the effectiveness of the channels at coupling to and redirecting flow. FIG. 18 shows a diffuser plate 1800 that includes recessed channels 1802 each having a convex side 1804 and a concave side 1806 (only one channel labeled) and also conceptually illustrates a higher angle streamline 1808 that has a flow angle with respect to a meridional reference plane that is approximately the same or slightly greater than an angle of channels 1802. Higher angle streamline 1808 may be expected to cross over convex side 1804 and enter the channel. FIG. 19 is one example of a cross sectional side view of channel 1802 and illustrates example edge features for the channel. In the illustrated example, on the convex side 1804 of channel 1802, the channel includes a transitional edge feature between the diffuser hub or shroud surface 1902 and a sidewalls 1904 of the channel in the form of a chamfered edge 1906 to help promote the ingress of flow into the channel. A depth, dl, of the chamfer may be varied to optimize the performance of the channel and in some examples the depth, dl, of the chamfer is in the range of 2%-50% of the depth of the channel. As indicated by the dotted line, in another example channel 1802 may include a transitional edge feature in the form of a fillet 1908 instead of a chamfer to promote the ingress of flow into the channel.

In the example shown in FIG. 19, the concave side 1806 of channel 1802 includes a cusp 1910 that extends laterally inward from channel sidewall 1904 and forms a scoop to capture flow and direct the flow into the channel. FIG. 19 includes arrows that conceptually illustrate fluid flow, with the channel edge features on the convex 1804 and concave 1806 sides of the channel promoting fluid flow into the channel. FIG. 20 shows another example of a transitional edge feature on the concave side 1806 of channel 1802 in the form of a cusp 2000 that extends both laterally from channel sidewall 2002 and vertically by a height, hl, from diffuser hub or shroud surface 2004 to provide a scoop to capture and redirect flow into the channel. Height, hl, of cusp 2000 may be varied to optimize the performance of the channel and in some examples the height, hl, is in the range of 2%-50% of the depth of the channel.

The channel edge features illustrated in FIGS. 19 and 20 can be combined in any combination, for example, a chamfer or fillet may be added to the channel illustrated in FIG. 20. The channel edge features may be reversed with a chamfer or fillet on the concave side 1806 and a cusp on the convex side.

In some examples, the edge geometry of a channel may vary with meridional location. For example, referring again to FIG. 18, high angle streamline 1808 intersects an upstream portion 1810 of channel 1802 first crossing the convex side 1804, whereas a low angle streamline 1812 intersects a downstream portion 1814 of the channel, first crossing the concave side 1806. Channels 1802 may be designed to capture both the high and low angle streamlines 1808, 1812 by incorporating a cusp, such as cusp 1910 or 2000 on concave side 1806 on upstream portion 1810 to capture high angle streamline 1808 and having the reverse configuration on the downstream portion 1814—a cusp on the convex side 1804 to capture the low angle streamline 1812. If channels 1802 are defined as extending from a beginning location at a meridional location, 0% M, to an ending location at a meridional location, 100% M, the upstream portion 1810 may extend from 0% M to 10% M, and in some examples, from 0% M to 20% M, and in some examples, from 0% M to 30% M, and in some examples, from 0% M to 40% M, and in some examples, from 0% M to 50% M, and in some examples, from 0% M to 60% M. The downstream portion 1814 may extend from 40% M to 100% M, and in some examples, from 50% M to 100% M, and in some examples, from 60% M to 100% M, and in some examples, from 70% M to 100% M, and in some examples, from 80% M to 100% M, and in some examples, from 90% M to 100% M.

More generally, in some examples, recessed channels may include an edge feature that forms a scoop on a convex side of at least a portion of the channel, such as a downstream portion of the channel, to capture more radial lower angle flow that may be more prevalent at higher flowrates and locations downstream of the diffuser inlet. And in some examples, the scoop on the convex side may begin at a first meridional location that is downstream of a beginning location of the channel and an opposing concave side of the channel may include a scoop along an upstream portion of the channel between the beginning location and the first meridional location.

Figure 21:
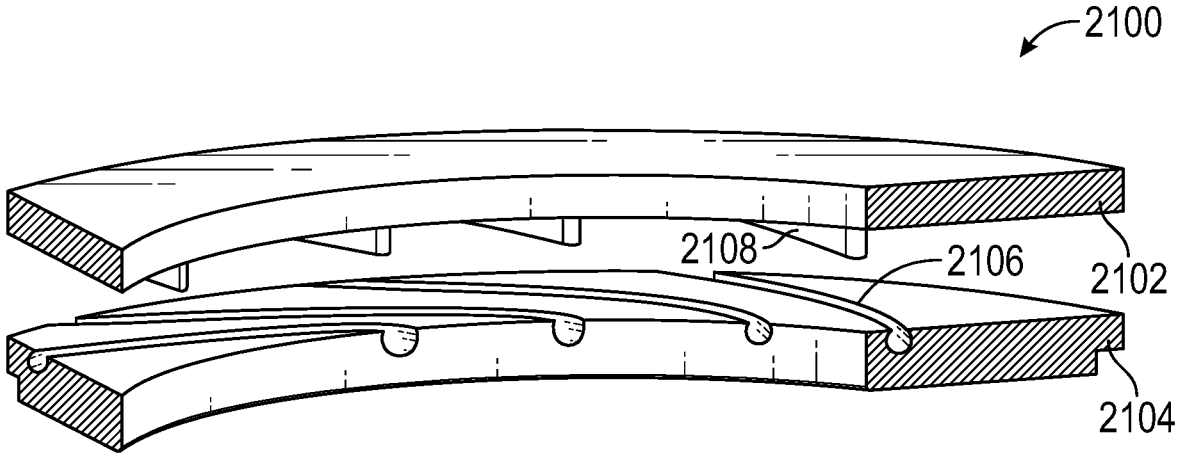
FIG. 21 is a perspective view of a diffuser with partial height vanes located adjacent a plurality of recessed channels.
Figure 22:
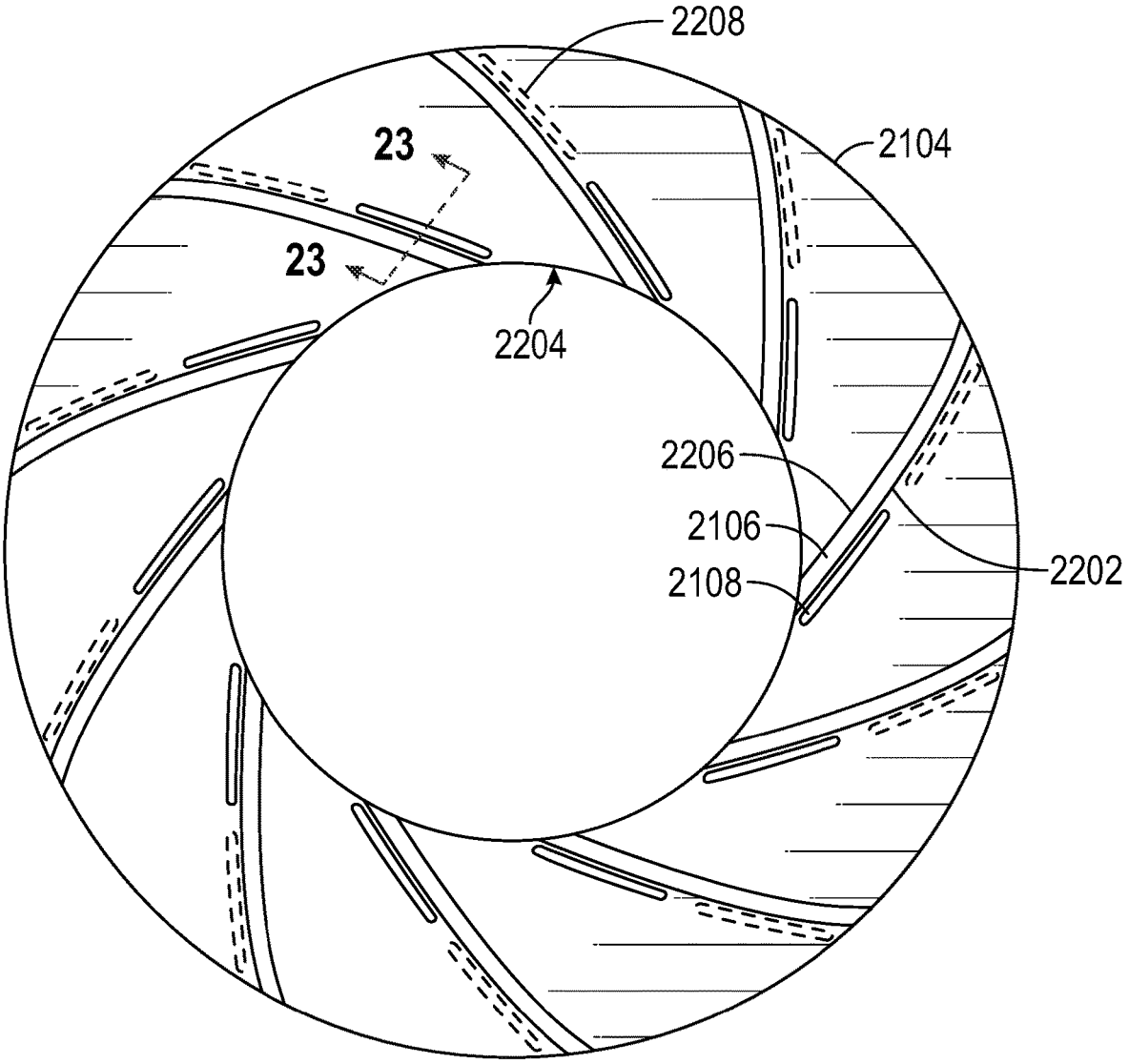
FIG. 22 is a top view of the diffuser of FIG. 21.
Figure 23:
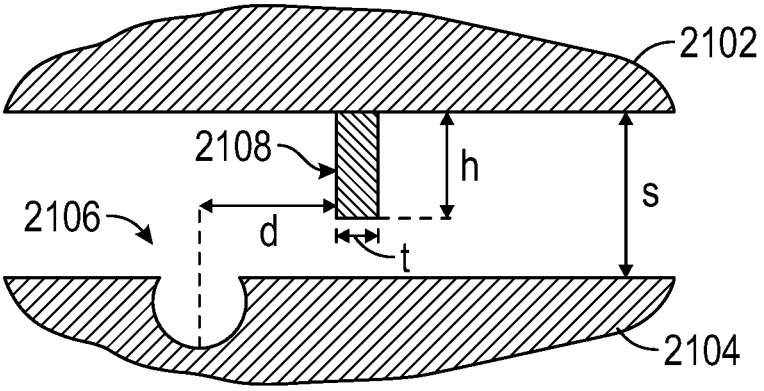
FIG. 23 is a side cross sectional view of a portion of the diffuser of FIG. 21.

FIGS. 21-23 illustrate another example implementation of a diffuser 2100 that includes flow control structures designed and configured to improve the performance of the diffuser and turbomachine. In the illustrated example, diffuser 2100 includes a top plate 2102 and a bottom plate 2104. Bottom plate 2104 includes a plurality of recessed channels 2106 that generally extend in a flow-wise direction and may have any of the geometries and features of any of the recessed channels disclosed herein. Diffuser 2100 also includes a plurality of partial height vanes 2108 that are affixed to top plate 2102 that are designed and configured to, among other things, increase the effectiveness of channels 2106 by creating a pressure distribution in the flow field proximate the channels that increases the coupling between the channels and the flow field. FIG. 22 is a top view of diffuser 2100 with top plate 2102 removed to further illustrate the positioning of partial height vanes 2108 relative to channels 2106. In the illustrated example, the partial height vanes are located adjacent a convex side 2202 of each channel 2106, have a length that is less than a length of the channels and are located adjacent an upstream portion of the channels proximate the diffuser inlet 2204.

In other examples, the vanes may be shorter or longer, including having the same length as the channels and may be located at any point along the channel, such as adjacent a downstream portion as indicated by the broken lines 2208 illustrating an alternate location for vanes 2108 or a location of an additional partial height vane. In another example vanes 2108 may be located on a concave side 2206 of channels 2106 at any point along the length of the channels. In one example, vanes 2108 may be located on concave side 2206 of channels 2106 adjacent, for example, an upstream portion and designed to redirect high angle tangential flow into the channels and additional partial height vanes may be located on convex side 2202, for example, adjacent a downstream location and designed to redirect low angle more radial flow into the channels. In other examples, a first subset of channels 2106 have partial height vanes 2108 adjacent concave sides 2206 and a second subset of the channels have partial height vanes 2108 adjacent convex sides 2202. And in some examples the first subset of channels have a different curvature or angle profile than the second subset of the channels, for example, the first subset of channels may have a higher or lower angle than the second subset of channels.

In the illustrated example, there are an equal number of partial height vanes 2108 and channels 2106. In other examples, the number of vanes 2108 may be greater or less. For example, the number of partial height vanes may be in the range of 10%-75% of the number of channels and in some examples, there may be ⅕, ⅓, or ½ as many partial height vanes 2108 as channels 2106.

FIG. 23 is a side cross sectional view of a portion of diffuser 2100 and shows one of partial height vanes 2108 and one of channels 2106. Partial height vanes 2108 may have a height, h, that is less than a spanwise distance, s, between the top plate 2102 and bottom plate 2104. The partial height vanes may have any height that is less than the spanwise distance, s, including a height, h in the range of 5%-90% of the spanwise distance, s, and in some examples, 5%-10%, and in some examples, 5%-15%, and in some examples, 5%-20%, and in some examples, 5%-25%, and in some examples, 5%-30%, and in some examples, 5%-35%, and in some examples, 5%-45%, and in some examples, 5%-55%, and in some examples, 45%-95%, and in some examples, 55%-95%, and in some examples, 65%-95%, and in some examples, 75%-95%, and in some examples, 85%-95% of the spanwise distance, s.

The partial height vanes 2108 may be spaced from a centerline of the channels 2106 by an offset distance, d, where the offset distance, d, is in the range of ½-10 times the vane thickness, t, and in some examples, in the range of ½-5 times the vane thickness, t, and in some examples, ½-3 times the vane thickness, t, and in some examples, ½-2 times the vane thickness, t. The partial height vanes may also have an incidence angle (the difference between the flow and vane angles) in the range of −5 to +25 degrees. One or more of the vane height, h, the vane offset, d, from an adjacent channel, and the vane incidence angle may be designed, configured, and selected to create a pressure distribution in the fluid flow field proximate the channels 2106 to increase the coupling of the channels to the flow field and improve the effectiveness of the channels.

Figure 24:
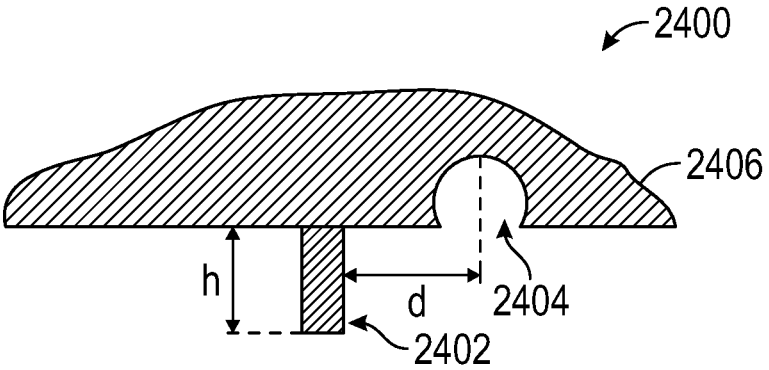
FIG. 24 is a side cross sectional view of a portion of another example of a diffuser with partial height vanes located adjacent a plurality of recessed channels.

FIG. 24 illustrates another example implementation in the form of a diffuser 2400 that is similar to diffuser 2100 except that it includes a plurality of partial height vanes 2402 (only one illustrated) that are affixed to the same side of the diffuser as a plurality of channels 2404 (only one illustrated). FIG. 24 is a side cross sectional view of a portion of a top plate 2406 of the diffuser 2400. The height, h, offset distance, d, and angle of incidence of partial height vanes 2402 may have any of the values disclosed above for partial height vanes 2108.

In yet other examples, the embodiments illustrated in FIGS. 21-23 and FIG. 24 may be combined in any way, for example, a diffuser may include recessed flow-wise channels on both the hub and shroud sides of the diffuser passage and may include partial height vanes on only one side or both sides. If on both sides, the partial height vanes may be positioned in an interdigitated alternating arrangement with a first partial height vane affixed to, e.g., the shroud side of the diffuser and a second partial height vane circumferentially spaced from the first partial height vane and affixed to a hub side of the diffuser followed by another first partial eight vane affixed to the shroud and so on. In another example, the embodiment illustrated in FIGS. 21-23 may be reversed with flow-wise channels located in the top plate 2102 and partial height vanes affixed to the bottom plate 2104. In another example, the embodiment illustrated in FIG. 24 may be reversed with flow-wise channels located in a bottom plate of a diffuser and partial height vanes also affixed to the bottom plate.

Figure 25:
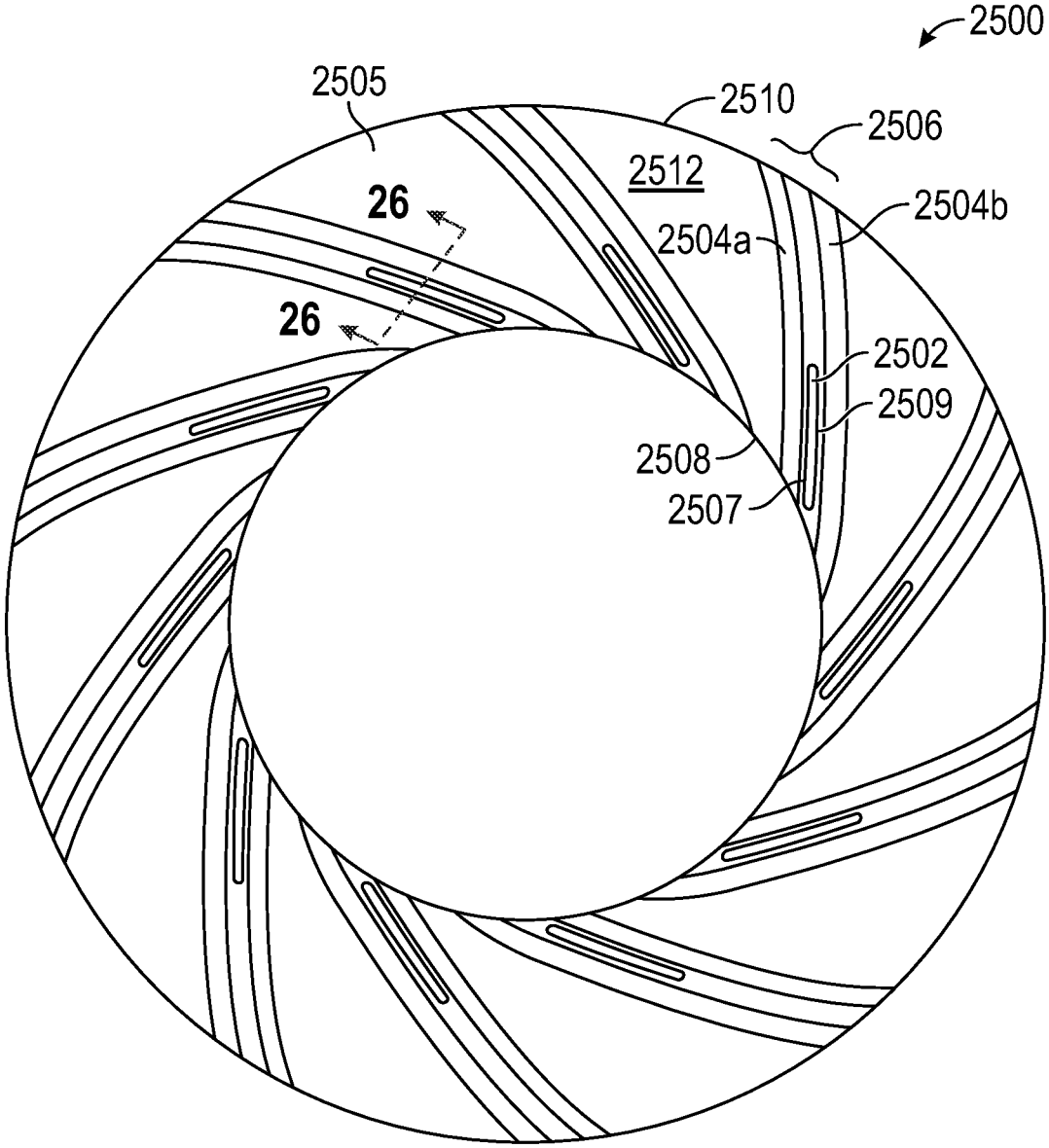
FIG. 25 is a top view of a diffuser with partial height vanes located adjacent a plurality of recessed channels.

FIG. 25 illustrates another example implementation of a diffuser 2500 that includes flow control structures for improving the performance of the diffuser and turbomachine, including a plurality of partial height vanes 2502 and a plurality of recessed channels 2504 located in diffuser plate 2505, where the diffuser plate can form the front or back plate of diffuser 2500. In the illustrated example there are a greater number of recessed channels 2504 than partial height vanes 2502 and the partial height vanes are selectively located between pairs 2506 of channels and no partial height vanes are located between adjacent pairs of channels. The pairs 2506 of channels include a pressure side channel 2504*b* located on a pressure side 2509 of vane 2502 and a suction side channel 2504*a* located on a suction side 2507 of the vane. In the illustrated example, the two channels 2504 in each pair 2506 are not in fluid communication and each extend from an inlet 2508 to an exit 2510 of the diffuser. In other examples, the two channels 2504 may combine into a single channel either upstream or downstream of the partial height vane 2502 or may intersect at an intersection point similar to channels 1202 and 1204 in FIGS. 12 and 13. In yet other examples, the two channels 2504 in a pair 2506 of channels may define distinct openings in surface 2512 of diffuser plate 2505 but may share a common fluid passageway submerged below the diffuser surface.

Figure 26:
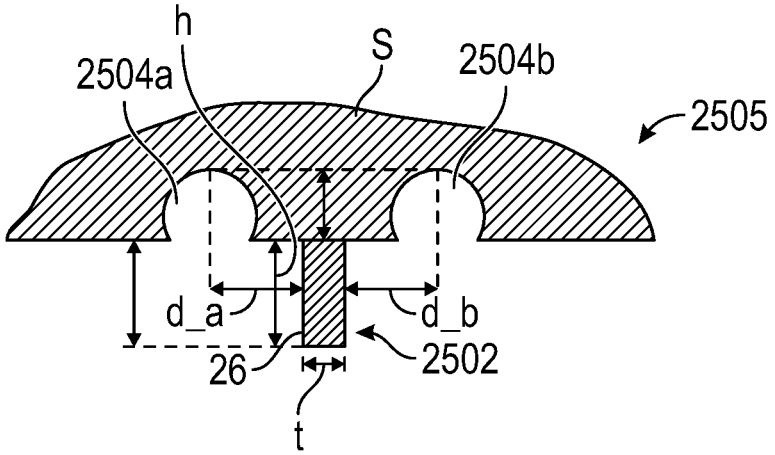
FIG. 26 is a side cross sectional view of a portion of the diffuser of FIG. 25.
Figure 27:
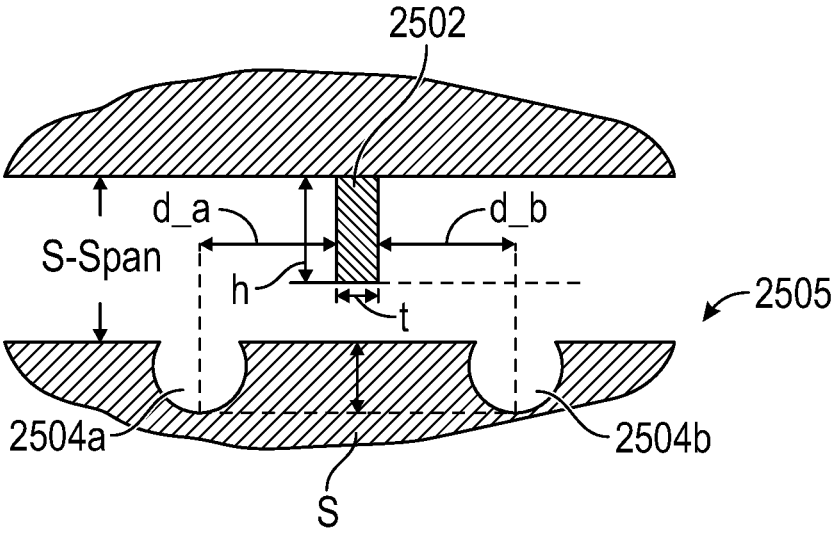
FIG. 27 is a side cross sectional view of a portion of another example of a diffuser with partial height vanes located adjacent a plurality of recessed channels.

FIGS. 26 and 27 are cross sectional side views of two alternate embodiments of diffuser 2500 illustrating the partial height vanes 2502 located between pairs 2506 of channels 2504 may be on the same or opposite side of the diffuser passageway. In the example illustrated in FIG. 26, partial height vane 2502 is affixed to diffuser plate 2505 and is equally spaced from channels 2504*a* and 2504*b* by a distance d_a, d_b and the pair 2506 of channels are spaced by a spacing distance, s. In the illustrated example, the spacing distance, s, is less than a spacing between adjacent pairs

2506 of channels and in one example, d_a and d_b are each in the range of t to 5t, where t is the thickness of vane 2502. In another example the spacing may be greater and in some examples, the distances d_a and d_b may not be the same. For example, d_a may be less than d_b and d_b may be in the range of 2*d_a to 5*d_a. In other words, vanes 2502 may be closer to pressure side channels 2504*a* and spaced a greater distance from suction side channels 2504*b* to prevent the vanes from blocking flow to the suction side channels. In other examples, the reverse may be used with vanes 2502 being located closer to suction side channels 2504*b*. The alternate embodiment illustrated in FIG. 27 may be constructed with the same ranges of spacing parameters d_a, d_b, and s. In some examples, the relative spacing between vane 2502 and channels 2504*a*, 2504*b* will be selected according to whether the vane is affixed to the same side of the diffuser passageway (FIG. 26) or the opposite side (FIG. 27) due to the differing effects of the vane on the flow field in the region of the channels 2504. In the examples illustrated in FIGS. 26 and 27 both channels 2504 in the pair 2506 of channels have substantially the same cross sectional shape, area, and depth. In other examples, the shape, size, or depths of the channels 2504 may be different, for example according to whether the channel is on the pressure side 2507 or suction side 2509 of the vane 2502 and whether the vane is affixed to the same or opposite side of the diffuser passageway. For example, the suction side vanes 2504*b* may be shallower and/or have a smaller cross sectional area than pressure side vanes 2504*a*. In other examples, the pressure side vanes 2504*a* may be shallower and/or have a smaller cross sectional area than suction side vanes 2504*b*.

The partial height vanes 2502 may have any height, h, that is less than the spanwise distance, s_span, of the diffuser passage including a height, h, in the range of 5%-90% of the spanwise distance, and in some examples, 5%-10%, and in some examples, 5%-15%, and in some examples, 5%-20%, and in some examples, 5%-25%, and in some examples, 5%-30%, and in some examples, 5%-35%, and in some examples, 5%-45%, and in some examples, 5%-55%, and in some examples, 45%-95%, and in some examples, 55%-95%, and in some examples, 65%-95%, and in some examples, 75%-95%, and in some examples, 85%-95% of the spanwise distance. In the example shown in FIG. 25, there are no partial height vanes located between the pairs 2506 of channels 2504. In other examples, an additional full or partial height vane may be located between the pairs of channels and in the case of partial height vanes, the partial height vanes may be affixed to the same or opposite side of the diffuser passageway as partial height vanes 2502.

Figure 28:
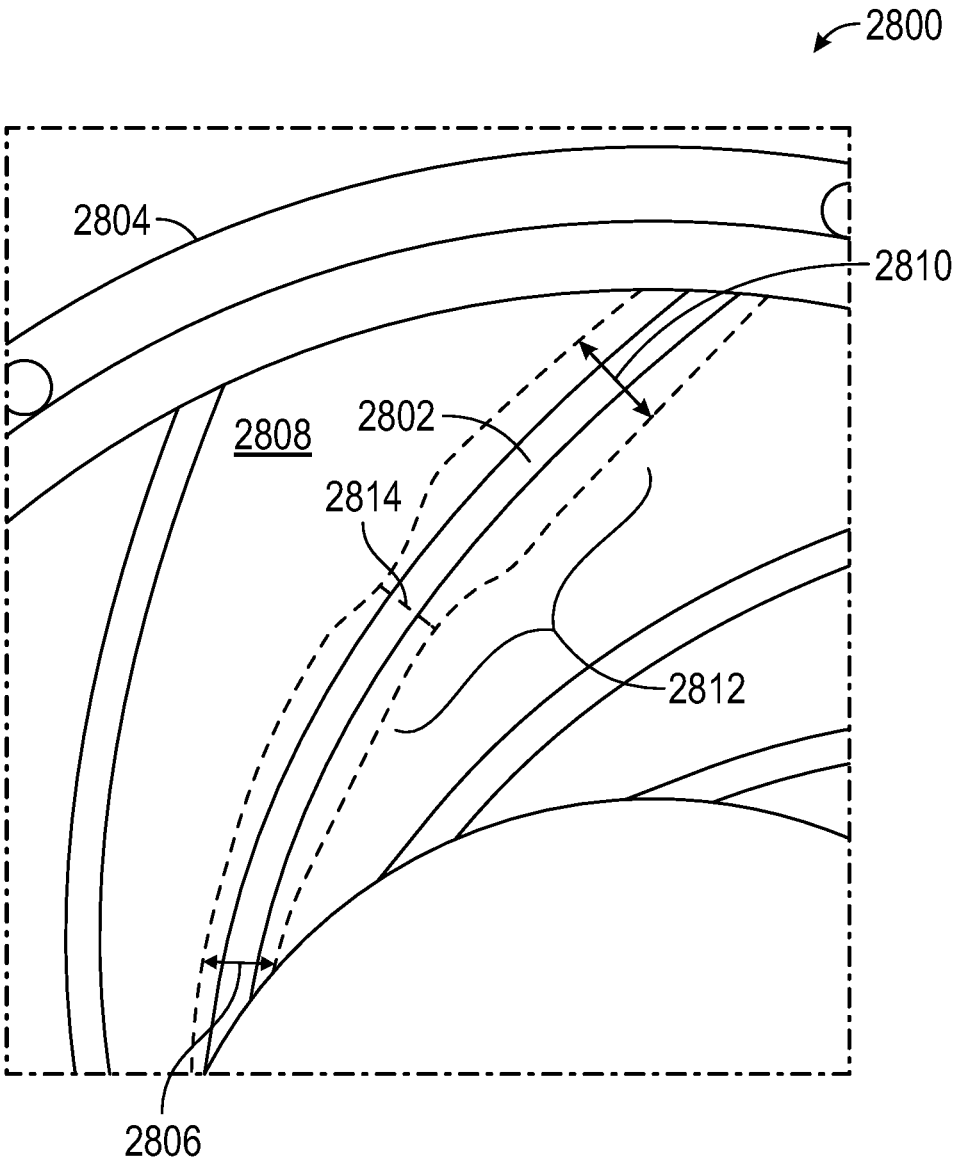
FIG. 28 illustrates another example implementation of a diffuser that includes a plurality of recessed channels, at least some of the recessed channels having a cross sectional area that varies along the length of the channel to form a converging-diverging nozzle.

FIG. 28 illustrates another example implementation of a diffuser 2800 that includes a plurality of recessed channels 2802 located in a diffuser plate 2804. Channels 2802 include an elongate opening 2806 in a surface 2808 of diffuser plate 2804 and also include a submerged portion 2810 that has a greater width than the width of opening 2806, the sides of the submerged portion of the channel passageway beneath surface 2808 are illustrated by broken lines in FIG. 28. As indicated by the broken lines, the width and cross sectional area of the submerged portion 2810 varies with meridional location and in the illustrated example is designed and configured to form a converging-diverging nozzle 2812 including a throat 2814 located at a meridional location M. As noted above in connection with FIGS. 3 and 4, a drop in performance at higher flowrates has been observed in some implementations of compressors with recessed channels. In some examples, the drop of performance may be attributed to choking of fluid flow within the channels. Thus, channels 2802 and converging-diverging nozzle 2812 are designed and configured to improve the performance of the channels at higher flowrates.

The foregoing has been a detailed description of illustrative embodiments of the disclosure. It is noted that in the present specification and claims appended hereto, conjunctive language such as is used in the phrases "at least one of X, Y and Z" and "one or more of X, Y, and Z," unless specifically stated or indicated otherwise, shall be taken to mean that each item in the conjunctive list can be present in any number exclusive of every other item in the list or in any number in combination with any or all other item(s) in the conjunctive list, each of which may also be present in any number. Applying this general rule, the conjunctive phrases in the foregoing examples in which the conjunctive list consists of X, Y, and Z shall each encompass: one or more of X; one or more of Y; one or more of Z; one or more of X and one or more of Y; one or more of Y and one or more of Z; one or more of X and one or more of Z; and one or more of X, one or more of Y and one or more of Z.

Various modifications and additions can be made without departing from the spirit and scope of this disclosure. Features of each of the various embodiments described above may be combined with features of other described embodiments as appropriate in order to provide a multiplicity of feature combinations in associated new embodiments. For example, any of the features of the examples of multiple sets of channels with differing angle profiles described and illustrated in FIGS. 12-16 can be combined with any of the features of examples of channel edge features described and illustrated in FIGS. 17-20 and/or any of the features of example implementations incorporating partial height vanes and recessed channels in FIGS. 21-27 and/or the example implementations of converging-diverging nozzles in FIG. 28. Furthermore, while the foregoing describes a number of separate embodiments, what has been described herein is merely illustrative of the application of the principles of the present disclosure. Additionally, although particular methods herein may be illustrated and/or described as being performed in a specific order, the ordering is highly variable within ordinary skill to achieve aspects of the present disclosure. Accordingly, this description is meant to be taken only by way of example, and not to otherwise limit the scope of this disclosure. In addition, any of the recessed channels disclosed herein that are located in a diffuser may extend upstream into an impeller or may be located entirely in an impeller rather than a diffuser. Any of the examples of partial height vanes disclosed herein may be modified to affix the partial height vanes to either side of a diffuser passageway and the diffuser may also include one or more full height vanes in the place of a partial height vane or in addition to the illustrated partial height vanes. The examples illustrated herein in connection with a radial compressor can be readily applied to mixed flow and radial pumps mixed flow compressors as well as axial, mixed flow, or radial fans and turbines. Any of the examples disclosed herein that include a recessed channel may be modified to incorporate the recessed channels on one or both sides of the turbomachine passageway.

What is claimed is:

1. A turbomachine, comprising:

a hub surface, a shroud surface, and a plurality of recessed channels located in the hub or shroud surface, each of the recessed channels extending in a flow-wise direction and having an angle profile, $\alpha(M)$, with respect to a meridional reference plane passing through a corresponding channel at a meridional location M along a length of the channel;

wherein the angle of at least a first portion of each of the channels is designed and configured to be equal to or less than a calculated minimum flow angle of a working fluid at a maximum mass flow rate operating point to thereby increase a coupling of the channels to the working fluid at the maximum mass flow rate operating point.

2. A turbomachine according to claim 1, wherein the maximum mass flow rate operating point is a mass flow rate that is at least 80% of a mass flow rate at a stage choke point or the maximum mass flow rate operating point is a stage choke point.

3. A turbomachine according to claim 1, wherein the maximum mass flow rate operating point is (1)+/−15% of a mass flow rate at a best efficiency point, (2)+/−15% of a mass flow rate at a choke point, (3) 20%-80% of a mass flow rate at a best efficiency point, (4) 20%-80% of a mass flow rate at a choke point, (5) a mass flow rate between a best efficiency point and a choke point.

4. A turbomachine according to claim 1, wherein the turbomachine includes an impeller and a diffuser, the diffuser having an inlet at a meridional distance, M, of 0% M and an exit at 100% M, wherein the plurality of recessed channels are at least partially located in the diffuser, wherein the first portions of the channels are located at least 20% M downstream of the diffuser inlet.

5. A turbomachine, comprising:

a hub surface, a shroud surface; and a plurality of recessed channels extending in a flow-wise direction and located in the hub or shroud surface;

wherein the plurality of channels includes a plurality of first channels and a plurality of second channels, wherein an angle of the first channels with respect to meridional location along the channel, $\alpha1(M)$, is different than an angle of the second channels with respect to meridional location along the channel, $\alpha2(M)$, wherein the angles, $\alpha1(M)$, $\alpha2(M)$, are an angle of a corresponding one of the first or second channels with respect to a meridional reference plane passing through the channel at a meridional location M along a length of the channel.

6. A turbomachine according to claim 5, wherein at least one of the first channels are in direct fluid communication with a corresponding one of the second channels.

7. A turbomachine according to claim 5, wherein at least one of the first channels intersects a corresponding one of the second channels.

8. A turbomachine according to claim 5, wherein the turbomachine includes a diffuser having an inlet and an exit, wherein the first and second channels each extend from the diffuser inlet to the diffuser exit.

9. A turbomachine according to claim 5, wherein the turbomachine includes a diffuser having an inlet and an exit, wherein each of the first channels extend from the diffuser inlet to the diffuser exit and each of the second channels has a beginning location proximate the diffuser inlet and an ending location at an intersection point where the corresponding second channel intersects a corresponding one of the first channels.

10. A turbomachine according to claim 5, wherein the turbomachine includes a diffuser having an inlet and an exit, wherein each of the first channels extend from the diffuser inlet to the diffuser exit and each of the second channels has a beginning location located downstream of the diffuser inlet.

11. A turbomachine according to claim 5, wherein the angle, $\alpha1(M)$, of the first channels is greater than the angle, $\alpha2(M)$, of the second channels for all values of M.

12. A turbomachine according to claim 5, wherein the angle, $\alpha(M)$, of the first channels is less than the angle, $\alpha(M)$, of the second channels for all values of M.

13. A turbomachine, comprising:

a hub surface, a shroud surface; and a plurality of recessed channels extending in a flow-wise direction and located in the hub or shroud surface, each of the channels having a first edge at the hub or shroud surface on a convex side of the channel and a second edge at the hub or shroud surface on a concave side of the channel;

wherein at least a portion of at least one of the first and second edges of at least one of the plurality of channels includes a cusp that forms a scoop to capture and redirect flow into the channel.

14. The turbomachine according to claim 13, wherein the cusp extends laterally from a side wall of the channel.

15. The turbomachine according to claim 13, wherein the cusp extends vertically from the hub or shroud surface.

16. The turbomachine according to claim 13, wherein the cusp is located along at least a portion of the first edge of at least one of the channels.

17. The turbomachine according to claim 13, wherein the cusp is located along at least a portion of the second edge of at least one of the channels.

18. The turbomachine according to claim 13, wherein the cusp is located along an upstream portion of at least one of the channels.

19. The turbomachine according to claim 18, wherein the channels extend from a beginning location at a meridional location, 0% M, to an ending location at a meridional location, 100% M, wherein the upstream portion extends from 0% M to 50% M.

20. The turbomachine according to claim 13, wherein the cusp is located along a downstream portion of at least one of the channels.

21. The turbomachine according to claim 20, wherein the channels extend from a beginning location at a meridional location, 0% M, to an ending location at a meridional location, 100% M, wherein the downstream portion extends from 50% M to 100% M.

22. The turbomachine according to claim 13, wherein the cusp includes a first cusp formed along an upstream portion of the second edge of at least one of the channels and a second cusp formed along a downstream portion of the first edge of the at least one channel.

23. The turbomachine according to claim 22, wherein a downstream portion of the second edge of the at least one channel does not include a cusp and the upstream portion of the first edge of the at least one channel does not include a cusp.

24. The turbomachine according to claim 22, wherein the downstream portion of the second edge of the at least one channel includes a chamfer or fillet and the upstream portion of the first edge of the at least one channel includes a chamfer or fillet.

25. The turbomachine according to claim 13, wherein at least a portion of at least one of the first or second edges of at least one of the plurality of channels includes a chamfer or fillet to facilitate the entrance of fluid flow into the channel.

* * * * *